US011624986B2

(12) United States Patent
Kanno et al.

(10) Patent No.: US 11,624,986 B2
(45) Date of Patent: Apr. 11, 2023

(54) TONER AND METHOD FOR MANUFACTURING TONER

(71) Applicant: CANON KABUSHIKI KAISHA, Tokyo (JP)

(72) Inventors: Ichiro Kanno, Chiba (JP); Takeshi Hashimoto, Ibaraki (JP); Kentaro Kamae, Kanagawa (JP); Hayato Ida, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 134 days.

(21) Appl. No.: 17/117,883

(22) Filed: Dec. 10, 2020

(65) Prior Publication Data

US 2021/0181649 A1 Jun. 17, 2021

(30) Foreign Application Priority Data

Dec. 13, 2019 (JP) ..... JP2019-225355

(51) Int. Cl.
*G03G 9/087* (2006.01)
*G03G 9/08* (2006.01)
*G03G 9/097* (2006.01)

(52) U.S. Cl.
CPC ..... *G03G 9/08728* (2013.01); *G03G 9/081* (2013.01); *G03G 9/0819* (2013.01); *G03G 9/08724* (2013.01); *G03G 9/08731* (2013.01); *G03G 9/08755* (2013.01); *G03G 9/09783* (2013.01)

(58) Field of Classification Search
CPC ..... G03G 9/08755; G03G 9/0819; G03G 9/0823; G03G 9/08711; G03G 9/09708; G03G 9/09716; G03G 9/107
See application file for complete search history.

(56) References Cited

U.S. PATENT DOCUMENTS 8,084,174 B2 12/2011 Hasegawa et al.
8,323,726 B2 12/2012 Naka et al.
8,921,023 B2 12/2014 Baba et al.
8,927,188 B2 1/2015 Naka et al.
8,974,994 B2 3/2015 Kamae et al.
8,986,914 B2 3/2015 Fujikawa et al.
9,057,970 B2 6/2015 Ida et al.
9,058,924 B2 6/2015 Komatsu et al.
9,063,443 B2 6/2015 Ishigami et al.
9,152,088 B1 10/2015 Kobori et al.
9,239,529 B2 1/2016 Nosella et al.
9,348,247 B2 5/2016 Ida et al.
9,348,253 B2 5/2016 Kanno et al.
9,417,540 B2 8/2016 Hashimoto et al.
9,436,112 B2 9/2016 Iwasaki et al.
9,540,483 B2 1/2017 Ida et al.
9,575,426 B2 * 2/2017 Shimano ..... G03G 9/08795
9,651,883 B2 5/2017 Hama et al.
9,665,023 B2 5/2017 Kamae et al.
9,665,026 B2 5/2017 Iwasaki et al.
9,696,644 B2 7/2017 Ida et al.
9,897,934 B2 2/2018 Tamura et al.
9,915,885 B2 3/2018 Katsumata et al.
9,969,834 B2 5/2018 Ohtsu et al.
10,012,918 B2 7/2018 Ishigami et al.
10,012,920 B2 7/2018 Shibata et al.
10,012,921 B2 7/2018 Kamae et al.
10,036,970 B2 7/2018 Kanno et al.
10,078,281 B2 9/2018 Ida et al.
10,082,743 B2 9/2018 Hama et al.
10,088,765 B2 10/2018 Miyakai et al.
10,133,201 B2 11/2018 Kamae et al.
10,146,146 B2 12/2018 Komatsu et al.
10,175,595 B2 1/2019 Onozaki et al.
10,197,936 B2 2/2019 Onozaki et al.
10,203,619 B2 2/2019 Yamashita et al.
10,216,108 B2 2/2019 Iwasaki et al.
10,228,629 B2 3/2019 Tamura et al.
10,234,777 B2 3/2019 Ohtsu et al.
(Continued)

FOREIGN PATENT DOCUMENTS

JP 2012133353 A 7/2012
JP 2014130243 A 7/2014
(Continued)

OTHER PUBLICATIONS

UCLA Chemistry & Biochemistry, Solvent, May 5, 2016, Polarity Index of Chloroform and Tetrahydrofuran (Year: 2016).*
U.S. Appl. No. 17/092,602, Kentaro Kamae, filed Nov. 9, 2020.
U.S. Appl. No. 17/116,402, Takeshi Hashimoto, filed Dec. 9, 2020.
U.S. Appl. No. 17/117,444, Ichiro Kanno, filed Dec. 10, 2020.
U.S. Appl. No. 17/118,960, Masayuki Hama, filed Dec. 11, 2020.
U.S. Appl. No. 17/188,041, Takeshi Hashimoto, filed Mar. 1, 2021.
U.S. Appl. No. 17/189,794, Kentaro Kamae, filed Mar. 2, 2021.

*Primary Examiner* — Peter L Vajda
(74) *Attorney, Agent, or Firm* — Venable LLP

(57) ABSTRACT

A toner is provided, which has a toner particle containing a binder resin including a first resin and a second resin, wherein the first resin is a crystalline resin, the second resin is an amorphous resin, the first resin contains a specific amount of a first monomer unit having a specific structure, an acid value of the first resin and an acid value of the second resin are within specific ranges, a domain-matrix structure formed of a matrix containing the first resin and domains containing the second resin appears in cross-sectional observation of the toner, the toner particle contains a multivalent metal element, the multivalent metal element is at least one metal element selected from the group consisting of Mg, Ca, Al, Fe and Zn, and a total content of the multivalent metal element is within a specific range.

19 Claims, No Drawings

(56) References Cited

U.S. PATENT DOCUMENTS

| | | | |
|---|---|---|---|
| 10,274,851 | B2 | 4/2019 | Hashimoto et al. |
| 10,353,312 | B2 | 7/2019 | Kamae et al. |
| 10,401,748 | B2 | 9/2019 | Hashimoto et al. |
| 10,423,086 | B2 | 9/2019 | Hama et al. |
| 10,423,090 | B2 | 9/2019 | Ohtsu et al. |
| 10,451,986 | B2 | 10/2019 | Sano et al. |
| 10,451,990 | B2 | 10/2019 | Kamae et al. |
| 10,474,049 | B2 | 11/2019 | Onozaki et al. |
| 10,514,624 | B2 | 12/2019 | Tamura et al. |
| 10,564,560 | B2 | 2/2020 | Onozaki et al. |
| 10,599,060 | B2 | 3/2020 | Kanno et al. |
| 10,656,545 | B2 | 5/2020 | Kamae et al. |
| 10,775,710 | B1 | 9/2020 | Kamae et al. |
| 2013/0108955 | A1 | 5/2013 | Shibata et al. |
| 2013/0244159 | A1 | 9/2013 | Ishigami et al. |
| 2013/0288173 | A1 | 10/2013 | Hashimoto et al. |
| 2014/0134535 | A1 | 5/2014 | Baba et al. |
| 2014/0329176 | A1 | 11/2014 | Kanno et al. |
| 2015/0099227 | A1 | 4/2015 | Ida et al. |
| 2016/0109820 | A1 | 4/2016 | Hashimoto et al. |
| 2017/0315463 | A1 | 11/2017 | Onozaki et al. |
| 2018/0088478 | A1* | 3/2018 | Ida ..... G03G 9/0804 |
| 2018/0275540 | A1 | 9/2018 | Matsuo et al. |
| 2018/0314176 | A1 | 11/2018 | Ikeda et al. |
| 2018/0314177 | A1* | 11/2018 | Ogawa ..... G03G 9/09321 |
| 2019/0384193 | A1 | 12/2019 | Hashimoto et al. |
| 2019/0384202 | A1 | 12/2019 | Shirayama et al. |
| 2020/0057397 | A1 | 2/2020 | Murayama et al. |
| 2020/0073263 | A1 | 3/2020 | Hama et al. |
| 2020/0166862 | A1 | 5/2020 | Onozaki et al. |
| 2020/0183295 | A1 | 6/2020 | Kanno et al. |
| 2020/0233327 | A1 | 7/2020 | Honda et al. |
| 2020/0272068 | A1 | 8/2020 | Ochi et al. |
| 2020/0301301 | A1 | 9/2020 | Chimoto et al. |

FOREIGN PATENT DOCUMENTS

| | | |
|---|---|---|
| JP | 2014142632 A | 8/2014 |
| WO | 2019073731 | 4/2019 |

* cited by examiner

TONER AND METHOD FOR MANUFACTURING TONER

BACKGROUND OF THE INVENTION

Field of the Invention

The present disclosure relates to a toner for use in electrophotographic systems, electrostatic recording systems, electrostatic printing systems and the like, and relates to a method for manufacturing the toner.

Description of the Related Art

As electrophotographic full color copiers have proliferated in recent years, there has been increased demand for higher printer speeds and greater energy savings. To achieve high-speed printing, techniques have been studied for melting the toner more rapidly in the fixing step. Techniques have also been studied for reducing the various control times within jobs and between jobs in order to increase productivity. As strategies for saving energy, techniques have been studied for fixing the toner at a lower temperature in order to reduce the energy expenditure in the fixing step.

It is known that when a crystalline resin having sharp melt properties is used as a principal component of a binder resin in a toner, the toner has more excellent low-temperature fixability than a toner having an amorphous resin as a principal component. Many toners have been proposed, which contain crystalline polyesters as resins having sharp melt properties. However, crystalline polyesters have been problematic in terms of charging stability in high-temperature high-humidity environments, and especially in terms of maintaining charging performance after being left in high-temperature high-humidity environments.

Various toners have also been proposed, which use crystalline vinyl resins as other types of crystalline resins having sharp melt properties.

For example, Japanese Patent Application Publication No. 2014-130243 proposes a toner, with which both low-temperature fixability and heat-resistant storage stability are achieved, by using an acrylate resin having crystallinity in side-chains.

The toner of the above patent document can provide both low-temperature fixability and heat-resistant storage stability, and also provides improvement to a certain extent in charging stability, which has been a weak point of toners using crystalline polyester resins. However, it has been found that a toner using a crystalline vinyl resin as a binder resin is liable to hot offset and wrapping because viscosity thereof is too low in high-temperature regions, and has a narrow temperature range for fixing.

Research has therefore been conducted into adding an amorphous resin to a crystalline resin to raise the viscosity after toner melting.

For example, WO 2019/073731 proposes a toner using a binder resin in which a crystalline vinyl resin and a polyester resin crosslinked by carbon-carbon bonds are combined.

SUMMARY OF THE INVENTION

However, it has been found that while the toner of WO 2019/073731 ensures a fixing range to a certain extent, further improvement is still needed.

The present disclosures provide a toner that achieves excellent low-temperature fixability, hot offset resistance and wrapping resistance at the same time, and provides a method for manufacturing the toner.

One aspect of the present disclosure provides a toner comprising a toner particle containing a binder resin including a first resin and a second resin, wherein the first resin is a crystalline resin, the second resin is an amorphous resin, the first resin has a first monomer unit represented by formula (1) below, a content ratio of the first monomer unit in the first resin is 30.0 mass % to 99.9 mass %, an acid value of the first resin is 0.1 mg KOH/g to 30 mg KOH/g, an acid value of the second resin is 0.5 mg KOH/g to 40 mg KOH/g, a domain-matrix structure formed of a matrix containing the first resin and domains containing the second resin appears in cross-sectional observation of the toner, the toner particle further contains a multivalent metal element, the multivalent metal element is at least one metal element selected from the group consisting of Mg, Ca, Al, Fe and Zn, and a total content of the multivalent metal element is 0.0025 mass parts to 3.0000 mass parts per 100 mass parts of the binder resin:

in formula (1), $R_{Z1}$ represents a hydrogen atom or methyl group, and R represents a $C_{18-36}$ alkyl group.

Another aspect of the present disclosure provides a method for manufacturing a toner, the method comprising:

a step of preparing a resin fine particle dispersion containing a binder resin;

a step of adding a flocculant to the resin fine particle dispersion to form aggregate particles; and a step of heating and fusing the aggregate particles to obtain a dispersion containing a toner particle, wherein the binder resin contains a first resin and a second resin, the first resin is a crystalline resin, the second resin is an amorphous resin, the first resin has a first monomer unit represented by formula (1) below, a content ratio of the first monomer unit in the first resin is 30.0 mass % to 99.9 mass %, an acid value of the first resin is 0.1 mg KOH/g to 30 mg KOH/g, an acid value of the second resin is 0.5 mg KOH/g to 40 mg KOH/g, a domain-matrix structure formed of a matrix containing the first resin and domains containing the second resin appears in cross-sectional observation of the toner, the toner particle further contains a multivalent metal element, the multivalent metal element is at least one metal element selected from the group consisting of Mg, Ca, Al, Fe and Zn. and a total content of the multivalent metal element is 0.0025 mass parts to 3.0000 mass parts per 100 mass parts of the binder resin:

in formula (1), $R_{Z1}$ represents a hydrogen atom or methyl group, and R represents a $C_{18-36}$ alkyl group.

(1)

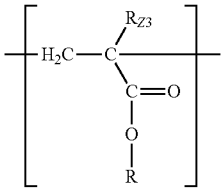

The present disclosures provide a toner that achieves excellent low-temperature fixability, hot offset resistance and wrapping resistance at the same time.

Further features of the present invention will become apparent from the following description of exemplary embodiments.

DESCRIPTION OF THE EMBODIMENTS

Unless otherwise specified, descriptions of numerical ranges such as "from X to Y" or "X to Y" in the present disclosure include the numbers at the upper and lower limits of the range.

In the present disclosure, a (meth)acrylic acid ester means an acrylic acid ester and/or a methacrylic acid ester.

When numerical ranges are described in stages, the upper and lower limits of each of each numerical range may be combined arbitrarily.

The term "monomer unit" describes a reacted form of a monomeric material in a polymer. For example, one carbon-carbon bonded section in a principal chain of polymerized vinyl monomers in a polymer is given as one unit. A vinyl monomer can be represented by the following formula (Z):

(Z)

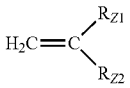

[in formula (Z), $R_{Z1}$ represents a hydrogen atom or alkyl group (preferably a $C_{1-3}$ alkyl group, or more preferably a methyl group), and $R_{Z2}$ represents any substituent].

A crystalline resin is a resin exhibiting a clear endothermic peak in differential scanning calorimetry (DSC) measurement.

The inventors believe that these effects are obtained by the following mechanism.

It is thought that the melting properties and fixing performance of the toner are determined by the domain-matrix structure in the binder resin in the toner particle interior. Conventionally, it has been known that the melting properties of a toner can be controlled by mixing a crystalline resin with an amorphous resin to obtain sharp-melt viscoelastic characteristics and improve elasticity in high-temperature regions.

However, the inventors' researches have shown that when a crystalline vinyl resin with strong sharp melt properties is used as the matrix of a domain-matrix structure in a binder resin, the dispersion state of domains formed by an amorphous resin is not ideal, and fixing performance is actually reduced. This is attributed to poor dispersion of the domains of the amorphous resin, which causes the domains to be too large.

Research into changing the composition of the binder resin has shown that fixing performance is somewhat improved by using a crystalline resin comprising a monomer having an acid value, such as an ester group. However, low-temperature fixability or hot offset resistance have been reduced with some compositions.

The inventors then discovered as a result of earnest research that these problems could be solved by controlling the acid value of the crystalline resin and the acid value of the amorphous resin in the toner and the content of a multivalent metal element within specific ranges.

In these disclosures, a domain-matrix structure composed of a matrix containing a first resin, which is a crystalline resin, and domains containing a second resin, which is an amorphous resin, appears in cross-sectional observation of the toner. Low-temperature fixability and hot offset resistance can both be achieved when such a domain-matrix structure is formed.

The first resin is a crystalline resin having a first monomer unit represented by formula (1).

The content ratio of the first monomer unit in the first resin is 30.0 mass % to 99.9 mass %. The acid value of the first resin is 0.1 mg KOH/g to 30 mg KOH/g. Because the first resin has such a first monomer unit, the binder resin has crystallinity and the low-temperature fixability of the toner is improved.

Low-temperature fixability and fixing separability are good when the content ratio of the first monomer unit in the first resin is 30.0 mass % to 99.9 mass %.

Low-temperature fixability declines if the content ratio of the first monomer unit is less than 30.0 mass %. The range is more preferably 40.0 mass % to 90.0 mass %, or still more preferably 45.0 mass % to 75.0 mass %. If the content ratio of the first monomer unit exceeds 99.9 mass %, the fixing separability may decline because too much of the first resin may be occupied by non-polar parts with low SP values.

The acid value of the first resin (crystalline resin) is 0.1 mg KOH/g to 30 mg KOH/g. If the acid value is within this range, low-temperature fixability and hot offset resistance are improved because the first resin and the multivalent metal element interact more easily, or in other words because ion crosslinking of the multivalent metal element to the resin is more likely to occur, and the dispersibility of the domains of the second resin can be more easily improved.

If the acid value of the first resin is less than 0.1 mg KOH/g, these effects are not obtained. If the acid value of the first resin exceeds 30 mg KOH/g, charge retention may decline in high-humidity environments in particular and fogging may occur because the hydrophobicity of the toner particle surface is reduced. A more preferred range is 5 mg KOH/g to 15 mg KOH/g.

(1)

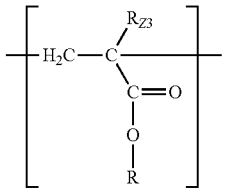

[In formula (1), $R_{Z1}$ represents a hydrogen atom or methyl group, and R represents a $C_{18-36}$ alkyl group (preferably a $C_{18-30}$ linear alkyl group).]

The first monomer unit represented by formula (1) is preferably a monomer unit derived from at least one selected from the group consisting of the (meth)acrylic acid esters having $C_{18-36}$ alkyl groups.

Examples of (meth)acrylic acid esters each having a $C_{18-36}$ alkyl group include (meth)acrylic acid esters each having a $C_{18-36}$ straight-chain alkyl group [stearl (meth) acrylate, nonadecyl (meth)acrylate, eicosyl (meth)acrylate, heneicosanyl (meth)acrylate, behenyl (meth)acrylate, lignoceryl (meth)acrylate, ceryl (meth)acrylate, octacosyl (meth) acrylate, myricyl (meth)acrylate, dotriacontyl (meth)acrylate, etc.] and (meth)acrylic acid esters each having a $C_{18-36}$ branched alkyl group [2-decyltetradecyl (meth)acrylate, etc.].

Of these, at least one selected from the (meth)acrylic acid esters having $C_{18-36}$ linear alkyl groups is preferred, at least one selected from the (meth)acrylic acid esters having $C_{18-30}$ linear alkyl groups is more preferred, and at least one selected from linear stearyl (meth)acrylate and behenyl (meth)acrylate is still more preferred from the standpoint of the low-temperature fixability, charge rising performance and charge stability of the toner.

One kind of monomer alone or a combination of at least two kinds of monomers may be used to form the first monomer unit.

The first resin is preferably a vinyl polymer. The vinyl polymer may for example be a polymer of a monomer containing ethylenically unsaturated bonds. An ethylenically unsaturated bond is a radical polymerizable carbon-carbon double bond, and examples include vinyl, propenyl, acryloyl and methacryloyl groups and the like.

The first resin preferably has a second monomer unit that is different from the first monomer unit and is at least one selected from the group consisting of the monomer units represented by formula (2) below and the monomer units represented by formula (3) below.

The content ratio of the second monomer unit in the first resin is preferably 1.0 mass % to 70.0 mass %, or more preferably 10.0 mass % to 60.0 mass %, or still more preferably 15.0 mass % to 30.0 mass %.

(2)

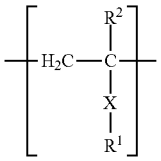

(3)

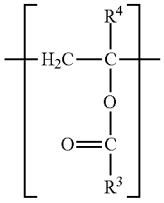

(In formula (2), X represents a single bond or $C_{1-6}$ alkylene group, $R^1$ represents a nitrile group (—C≡N), amido group (—C(=O)NHR$^{10}$ (in which $R^{10}$ represents a hydrogen atom or $C_{1-4}$ alkyl group)), hydroxy group, —COOR$^{11}$ (in which $R^{11}$ represents a $C_{1-6}$ (preferably $C_{1-4}$) alkyl group or $C_{1-6}$ (preferably $C_{1-4}$) hydroxyalkyl group), urea group (—NH—C(=O)—N($R^{13}$)$_2$ (in which of two $R^{13}$s independently represents a hydrogen atom or $C_{1-6}$ (preferably $C_{1-4}$) alkyl group)), —COO($CH_2$)$_2$—NHCOOR$^{14}$ (in which $R^{14}$ represents a $C_{1-4}$ alkyl group) or —COO($CH_2$)$_2$—NH—C(=O)—N($R^{15}$)$_2$ (in which of two $R^{15}$s independently represents a hydrogen atom or $C_{1-6}$ (preferably $C_{1-4}$) alkyl group), and $R^2$ represents a hydrogen atom or methyl group.)

(In formula (3), $R^3$ represents a $C_{1-4}$ alkyl group and $R^4$ represents a hydrogen atom or methyl group.)

When $SP_{21}$ is the SP value $(J/cm^3)^{0.5}$ of the second monomer unit, $SP_{21}$ is preferably at least 21.00 from the standpoint of fixing performance, or more preferably at least 25.00. There is no particular upper limit, but preferably it is not more than 40.00, or still more preferably not more than 30.00.

If the SP value of the second monomer unit is within this range, the crosslinking effect with the multivalent metal element is enhanced, and hot offset resistance is improved.

The content of the first resin (crystalline resin) in the binder resin is preferably at least 30.0 mass %.

Within this range, both low-temperature fixability and hot offset resistance can be achieved because it is easy to form a domain-matrix structure comprised of a matrix containing the first resin and domains containing the second resin. The content is more preferably at least 50.0 mass %, or still more preferably at least 55.0 mass %.

There is no particular upper limit, but preferably it is not more than 97.0 mass %, or more preferably not more than 75.0 mass %.

The content of the second resin (amorphous resin) in the binder resin is preferably at least 3.0 mass %, or more preferably at least 25.0 mass %. The upper limit is preferably not more than 70.0 mass %, or more preferably not more than 50.0 mass %, or still more preferably not more than 40.0 mass %.

One feature is that the acid value of the second resin (amorphous resin) is 0.5 mg KOH/g to 40 mg KOH/g. Within this range, low-temperature fixability and hot offset resistance are improved because the first resin and the multivalent metal element interact more easily, or in other words because ion crosslinking of the multivalent metal element to the resin is more likely to occur, and the effect of improving dispersal of the domains of the second resin is more easily obtained.

If the acid value of the second resin is less than 0.5 mg KOH/g, these effects are not obtained. If the acid value of the second resin exceeds 40 mg KOH/g, charge retention may decline in high-humidity environments in particular and fogging may occur because the hydrophobicity of the toner particle surface is reduced. A range of 1 mg KOH/g to 30 mg KOH/g is more preferred, 3 mg KOH/g to 25 mg KOH/g is still more preferred, and from 6 mg KOH/g to 20 mg KOH/g is yet more preferred.

Examples of the second resin include the following resins: monopolymers of styrenes and substituted styrenes, such as poly-p-chlorostyrene and polyvinyl toluene; styrene copolymers such as styrene-p-chlorostyrene copolymer, styrene-vinyl toluene copolymer, styrene-vinyl naphthaline copolymer, styrene-acrylic acid ester copolymers, styrene-methacrylic acid ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylene resin, polyvinyl butyral resin, terpene resin, coumarone-indene resin and petroleum-based resins.

Of these, from the standpoint of the charge rising performance the second resin is preferably at least one selected from the group consisting of the vinyl resins (such as styrene copolymers), polyester resins, and hybrid resins comprising vinyl resins linked to polyester resins. Linked here may mean linked by covalent bonds. The second resin more preferably contains a polyester resin, and still more preferably is a polyester resin.

The second resin is explained below using the example of a polyester resin.

The polyester resin is preferably a condensation polymer of an alcohol component and a carboxylic acid component.

The acid value of the second resin can be controlled for example by varying the contents and types of the alcohol units and carboxylic acid units in the amorphous resin.

An alcohol unit in the second resin is a structure obtained by condensation polymerization of a monomer that is an alcohol component, or in other words is a monomer unit derived from an alcohol component. Moreover, a carboxylic acid unit in the second resin is a structure obtained by condensation polymerization of a monomer that is a carboxylic acid component, or in other words is a monomer unit derived from a carboxylic acid component.

From the standpoint of the charge rising performance, a structure obtained by condensation polymerization of a bisphenol A alkylene oxide adduct preferably constitutes at least 75 mol %, or more preferably at least 80 mol %, or still more preferably at least 90 mol % of the alcohol units. An example of a bisphenol A alkylene oxide adduct is a compound represented by formula (A) below:

(A)

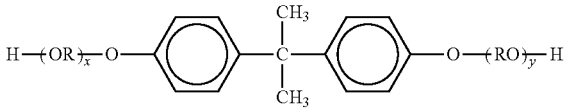

(in formula (A), each R is independently an ethylene or propylene group, each of x and y is 0 or an integer of at least 0, and the average value of x+y is from 0 to 10).

Considering the charge rising performance, the bisphenol A alkylene oxide adduct is preferably a bisphenol A propylene oxide adduct and/or ethylene oxide adduct, and more preferably is a propylene oxide adduct. The average value of x+y is preferably from 1 to 5, and more preferably from 1.6 to 2.8.

The following polyhydric alcohol components may be used as components other than the bisphenol A alkylene oxide adduct for forming the alcohol units:

ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,4,5-pentanetriol, glycerin, 2-methylpropantriol, 2-methyl-1,2,4-butanetriol, trimethylol ethane, trimethylol propane, 1,3,5-trihydroxymethyl benzene.

From the standpoint of low-temperature fixability and hot offset resistance, the peak molecular weight Mp of the second resin is preferably 3,000 to 30,000, or more preferably 5,000 to 20,000, or still more preferably 10,000 to 15,000.

The carboxylic acid units preferably include at least one selected from the group consisting of the aromatic dicarboxylic acid polycondensation structures, saturated aliphatic dicarboxylic acid polycondensation structures and unsaturated dicarboxylic acid polycondensation structures.

Examples of aromatic dicarboxylic acids include phthalic acid, isophthalic acid and terephthalic acid, and their anhydrides.

Alkyldicarboxylic acids such as oxalic acid, malonic acid, succinic acid, adipic acid, suberic acid, azelaic acid and sebacic acid and their anhydrides are desirable as saturated aliphatic dicarboxylic acids from the standpoint of charge rising performance.

Unsaturated dicarboxylic acids such as fumaric acid, maleic acid, citraconic acid, itaconic acid and succinic acid substituted with $C_{6-18}$ alkenyl groups, and anhydrides of these, are desirable as unsaturated dicarboxylic acids. It is especially desirable to include dodecenylsuccinic acid. It is more desirable to combine at least two of the above saturated aliphatic dicarboxylic acids and unsaturated dicarboxylic acids.

That is, preferably the second resin is a polyester resin, and the polyester resin has a polycondensation structure of dodecenylsuccinic acid or its anhydride. Moreover, the polyester resin preferably has a polycondensation structure of another carboxylic acid component in addition to the polycondensation structure of dodecenylsuccinic acid or its anhydride.

When the polyester resin has a polycondensation structure of dodecenylsuccinic acid or its anhydride, the toner has good hot offset resistance because interactions with the multivalent metal element are more likely, increasing the metal ion crosslinking effect.

The content of the polycondensation structure of dodecenylsuccinic acid or anhydride thereof in the carboxylic acid unit is preferably 10 mol % to 30 mol %, or more preferably 15 mol % to 20 mol %.

Considering the charge rising performance and hot offset resistance, the carboxylic acid units preferably include a polycondensation structure of an aromatic tricarboxylic acid or aromatic tetracarboxylic acid.

Examples of the aromatic tricarboxylic acid include trimellitic acid and trimellitic anhydride. Examples of aromatic tetracarboxylic acids include pyromellitic acid and pyromellitic anhydride.

The polycondensation structure of the aromatic carboxylic acid preferably constitutes 50 mol % to 80 mol %, or more preferably 55 mol % to 75 mol % of the carboxylic acid units.

Increasing the content ratio of aromatic carboxylic acids relative to aliphatic dicarboxylic acids is desirable for improving charge retention.

Examples of aromatic carboxylic acids include the aforementioned aromatic dicarboxylic acids, aromatic tricarboxylic acids and aromatic tetracarboxylic acids.

Other carboxylic acids for forming the carboxylic acid units include succinic acid or its anhydride substituted with $C_{6-18}$ alkyl groups, and polyvalent carboxylic acids such as 1,2,3,4-butanetetracarboxylic acid and benzophenonetetracarboxylic acid and their anhydrides.

The amorphous polyester resin can be manufactured using any commonly used catalysts, including metals such as tin, titanium, antimony, manganese, nickel, zinc, lead, iron, magnesium, calcium and germanium and compounds containing these metals.

Of these, a tin compound is desirable for improving charging performance. Examples of tin compounds include organic tin compounds such as dibutyl tin dichloride, dibutyl tin oxide, diphenyl tin oxide and the like. An organic tin compound here is a compound having Sn—C bonds.

An inorganic tin compound having no Sn—C bonds can also be used favorably. An inorganic tin compound here is a compound having no Sn—C bonds.

Examples of inorganic tin compounds include non-branched tin alkylcarboxylates such as tin diacetate, tin dihexanoate, tin dioctanoate and tin distearate, branched tin alkylcarboxylates such as tin dineopentylate and tin di(2-ethylhexanoate), tin carboxylates such as tin oxalate, and dialkoxytins such as dioctyloxytin and distearoxytin.

Of these tin compounds, a tin alkylcarboxylate or dialkoxytin is preferred, and tin dioctanoate, tin di(2-ethylhexanoate) and tin distearate, which are tin alkylcarboxylates having carboxyl residues in the molecule, are especially desirable.

The dielectric constant of the second resin (amorphous resin) at 2 kHz is preferably 2.0 pF/m to 3.0 pF/m. Within this range, charge retention is improved under high-temperature high-humidity conditions because charge transfer between the second resin and the inorganic fine particle is improved when an inorganic fine particle is added as an external additive. A range of 2.2 pF/m to 2.8 pF/m is more preferred. The dielectric constant of the second resin can be controlled by changing the monomer composition and acid value.

The binder resin preferably contains a third resin. The third resin preferably contains a resin comprising the first resin (crystal resin) linked to the second resin (amorphous resin), and more preferably is a resin comprising the first resin linked to the second resin. Good charge rising performance, low-temperature fixability and hot offset resistance are obtained when such a third resin is included. The third resin preferably has a structure in which at least parts of the first resin and second resin are linked together for example.

Methods of linking the first resin to the second resin include methods of crosslinking by applying a radical initiator to a mixture obtained by melting or fusing the first resin and second resin, and methods of crosslinking using a crosslinking agent having a functional group that reacts with both the first resin and the second resin and the like.

The radical initiator used in the methods of crosslinking using a radical initiator is not particularly limited, and may be an inorganic peroxide, organic peroxide, azo compound or the like. These radical reaction initiators may also be combined.

When both the first resin and the second resin have carbon-carbon unsaturated bonds, these bonds are cleaved when the first resin and second resin are crosslinked. When either or both of the first resin and second resin have no carbon-carbon unsaturated bonds, the two are crosslinked by extracting hydrogen atoms bonded to carbon atoms contained in the first resin and/or second resin. In this case, the radical initiator is more preferably an organic peroxide having strong hydrogen extraction ability.

The crosslinking agent having a functional group that reacts with both the first resin and the second resin is not particularly limited, and a known agent may be used, such as a crosslinking agent having an epoxy group, a crosslinking agent having an isocyanate groups, a crosslinking agent having an oxazoline group, a crosslinking agent having a carbodiimide group, a crosslinking agent having a hydrazide group, a crosslinking agent having an aziridine group or the like.

In methods of crosslinking using a crosslinking agent having a functional group that reacts with both the first resin and the second resin, both the first and second resin must have functional groups that react with the crosslinking agent.

A resin in which at least parts of the first resin and second resin crosslinked by the above method are linked together (that is, a resin composition containing the first resin and the second resin, and a third resin obtained by crosslinking the first and second resin) may be used to manufacture a toner.

When the toner is manufactured by a melt kneading method, a toner particle containing a resin comprising the first resin linked to the second resin can be manufactured by melt kneading a raw material mixture containing the first and second resin in the presence of the above radical initiator or crosslinking agent.

The content of the third resin in the binder resin is preferably 1.0 mas % to 20.0 mass %, or more preferably from 5.0 mass % to 15.0 mass %.

For example, the third resin is preferably a resin obtained by adding a radical reaction initiator while melt kneading an amorphous polyester resin having carbon-carbon double bonds (second resin) with the first resin to thereby perform a crosslinking reaction.

When the third resin is manufactured using the first resin and second resin, at least parts of the first resin and second resin link together to form the third resin. This yields a binder resin containing the first resin, the second resin and the third resin.

A binder resin containing the first resin, the second resin and the third resin can also be obtained by linking at least parts of the first resin and second resin. The binder resin can also be obtained by manufacturing the third resin separately and then mixing it with the first resin and second resin.

The radical reaction initiator used for this crosslinking reaction is not particularly limited, and may be an inorganic peroxide, organic peroxide, azo compound or the like. These radical reaction initiators may also be combined.

The inorganic peroxide is not particularly limited, and examples include hydrogen peroxide, ammonium peroxide, potassium peroxide, sodium peroxide and the like.

The organic peroxide is not particularly limited, and examples include benzoyl peroxide, di-t-butyl peroxide, t-butylcumyl peroxide, dicumyl peroxide, α,α-bis(t-butylperoxy)diisopropyl benzene, 2,5-dimethyl-2,5-bis(t-butylperoxy) hexane, di-t-hexyl peroxide, 2,5-dimethyl-2,5-di-t-butylperoxyhexine-3, acetyl peroxide, isobutyryl peroxide, octanoyl peroxide, decanoyl peroxide, lauroyl peroxide, 3,3,5-trimethylhexanoyl peroxide, m-toluyl peroxide, t-butyl peroxyisobutyrate, t-butyl peroxyneodecanoate, cumyl peroxyneodecanoate, t-butyl peroxy-2-ethylhexanoate, t-butylperoxy-3,5,5-trimethylhexanoate, t-butyl peroxylaurate, t-butyl peroxybenzoate, t-butyl peroxyisopropyl monocarbonate, t-butyl peroxyacetate and the like.

The azo compound or diazo compound is not particularly limited, and examples include 2,2'-azobis-(2,4-dimethylvaleronitrile), 2,2'-azobisisobutyronitrile, 1,1'-azobis(cyclohexan-1-carbonitrile), 2,2,'-azobis-4-methoxy-2,4-dimethylvaleronitrile, azobisisobutyronitrile and the like.

Of these, an organic peroxide is desirable because it has high initiator efficiency and does not produce toxic by-products such as cyan compounds.

A reaction initiator with high hydrogen extraction ability is desirable because the crosslinking reaction can proceed efficiency with a smaller amount of the initiator, and a radical reaction initiator with high hydrogen extraction ability such as t-butylperoxyisopropyl monocarbonate, benzoyl peroxide, di-t-butyl peroxide, t-butylcumyl peroxide, dicumyl peroxide, α,α-bis(t-butylperoxy)diisopropyl benzene, 2,5-dimethyl-2,5-bis(t-butylperoxy) hexane or di-t-hexylperoxide is even more desirable.

The amount of the radical reaction initiator used is not particularly limited, but is preferably 0.1 to 50 mass parts, or more preferably 0.2 to 5 mass parts per 100 mass parts of the binder resin to be crosslinked.

From the standpoint of low-temperature fixability, hot offset resistance and charge retention, the mass ratio X/Y of the content X of the first resin to the content Y of the second resin in the binder resin is preferably 0.2 to 2.5, or more preferably 2.0 to 2.4.

From the standpoint of low-temperature fixability and hot offset resistance, the number-average diameter of the domains in cross-sectional observation of the toner is preferably 0.1 μm to 2.0 μm, or more preferably 0.5 μm to 1.5 μm.

If the number-average diameter of the domains is not more than 2.0 μm, fixing performance is improved because the crystalline resin of the matrix and the amorphous resin of the domains melt more easily when the toner particle is fixed. Moreover, hot offset is suppressed because the viscosity of the melted matrix is maintained at an appropriate level in high-temperature regions.

If the number-average diameter of the domains is at least 0.1 μm, low-temperature fixability is improved because the sharp melt property of the crystalline resin can be properly obtained.

The number-average diameter of the domains can be controlled by means of the monomer compositions and manufacturing conditions of the crystalline resin and amorphous resin and the like.

Multivalent Metal Element

The toner particle contains a multivalent metal element. The multivalent metal element is at least one selected from the group consisting of Mg, Ca, Al, Fe and Zn. When this multivalent metal element is included, the multivalent metal element orients itself at the polar parts of the first and second resin, and can form network crosslinks that contribute to toner fixing performance. A toner with excellent low-temperature fixability and hot offset resistance can be obtained as a result.

Preferably the toner particle contains a multivalent metal element in a non-phase separated state. A non-phase separated state is an invisible state for example. This means that a multivalent metal with a particle diameter of not more than 100 nm is included for example. In the observation method discussed below, the particle diameter is judged to be not more than 100 nm if the particle diameter of the multivalent metal cannot be observed.

If the multivalent metal element does not include at least one selected from the group consisting of Mg, Ca, Al, Fe and Zn or when a multivalent metal element such as Sr or Ba having a higher molecular weight is selected, the amount of crosslinking points is reduced relative to the added amount of the multivalent metal element, and the crosslink formation effect declines. Low-temperature fixability, hot offset resistance and charge retention are lower as a result.

The compound containing the multivalent metal element is preferably a non-magnetic compound. The toner is preferably a non-magnetic toner.

The total content of the multivalent metal element in the toner is 0.0025 to 3.0000 mass parts per 100 mass parts of the binder resin. If the content ratio of the multivalent metal element is within this range, crosslinking can occur appropriately between the first monomer unit and the multivalent metal element, forming crosslinking parts that improve the low-temperature fixability and hot offset resistance.

If the content ratio of the multivalent metal element is less than 0.0025 mass parts, crosslinking points are reduced between the multivalent metal element and the polar parts of the first and second resin. Low-temperature fixability and hot offset resistance are also reduced because the effect of improving dispersal the domains of the second resin in the domain-matrix structure is not obtained.

If the content ratio of the multivalent metal element exceeds 3.0000 mass parts, on the other hand, low-temperature fixability and charging performance are reduced because the crosslinking parts between the polar parts and the multivalent metal element becoming excessive.

The content ratio of the multivalent metal element is preferably 0.0025 to 0.0500 mass parts, or more preferably 0.0150 to 0.0300 mass parts per 100 mass parts of the binder resin.

Preferably the content ratio of the multivalent metal element in the toner and the content ratio of the first monomer unit in the first resin are in the relationship shown by formula (2) below:

$$(\text{Mass parts of multivalent metal element per 100 mass parts of binder resin in toner particle}) \times 10000/(\text{content ratio of first monomer unit in the first resin}) \geq 0.5 \text{ (mass parts/mass \%)} \quad (2)$$

If formula (2) above is satisfied, this means that the ratio of the multivalent metal element and the polar parts is within a range at which interactions between the multivalent metal element and the crystalline resin are likely to occur. Within this range, excellent low-temperature fixability, hot offset resistance and charge retention are obtained because domains of the amorphous resin can be finely dispersed in the matrix of the crystalline resin to form a suitable domain-matrix structure. (Mass parts of multivalent metal element per 100 mass parts of binder resin in toner particle)×10000/(content ratio of first monomer unit in the first resin) is more preferably 1.0 to 5.0.

Preferably the toner particle contains a monovalent metal element, and the monovalent metal element is at least one selected from the group consisting of Na, Li and K. When this monovalent metal element is included, the polar parts in the binder resin can form not only crosslinks between the polar parts and the multivalent metal element, but also crosslinked parts between the polar parts and the monovalent metal element. This results in a toner with excellent low-temperature fixability, hot offset resistance and charging performance.

The content of the monovalent metal element is preferably 45 mass % to 90 mass % based on the total of the contents of the multivalent metal element and the monovalent metal element. A monovalent metal element content within this range is desirable from the standpoint of low-temperature fixability, hot offset resistance and charge retention.

The content of the monovalent metal element is more preferably 60 mass % to 80 mass % based on the total of the contents of the multivalent metal element and the monovalent metal element.

The complex elastic modulus of the toner at 65° C. is preferably $1.00\times10^7$ Pa to $5.00\times10^7$ Pa. The complex elastic modulus of the toner at 85° C. is preferably not more than $1.00\times10^6$ Pa.

If the complex elastic modulus at 65° C. is $1.00\times10^7$ Pa to $5.00\times10^7$ Pa, crosslinks form favorably between the polar parts and at least one of the multivalent metal element and the monovalent metal element, resulting in even more excellent low-temperature fixability and hot offset resistance.

If the complex elastic modulus at 85° C. is not more than $1.00\times10^6$ Pa, the crosslinks formed between the polar parts and at least one of the multivalent metal element and the monovalent metal element have a suitable strength that is released when the melting point is exceeded, resulting in more excellent low-temperature fixability.

The complex elastic modulus of the toner at 65° C. is preferably $2.00\times10^7$ Pa to $4.50\times10^7$ Pa.

The complex elastic modulus of the toner at 85° C. is preferably not more than $0.95\times10^6$ Pa. There is no particular lower limit, but preferably the complex elastic modulus of the toner at 85° C. is at least $0.10\times10^6$ Pa.

The complex elastic modulus can be controlled by controlling the monomer composition, molecular weight and manufacturing conditions of the binder resin and the like.

The average circularity of the toner is preferably 0.950 to 0.999, or more preferably 0.960 to 0.990.

The first resin (crystalline resin) may also contain a third monomer unit different from the first monomer unit represented by formula (1) above and the second monomer unit represented by formula (2) or (3) above.

Polymerizable monomers capable of forming the third monomer unit include styrenes such as styrene and o-methylstyrene, and their derivatives, (meth)acrylic acid esters such as 2-ethylhexyl (meth)acrylate, and (meth)acrylic acid.

The content ratio of the third monomer unit in the first resin is preferably 1.0 mass % to 30.0 mass %, or more preferably 5.0 mass % to 20.0 mass %.

Colorant

The toner may include a colorant, if necessary. Examples of the colorant are presented hereinbelow.

Examples of the black colorant include carbon black and colorants toned in black by using a yellow colorant, a magenta colorant and a cyan colorant. A pigment may be used alone, and a dye and a pigment may be used in combination as the colorant. It is preferable to use a dye and a pigment in combination from the viewpoint of image quality of a full-color image.

Examples of pigments for magenta toners include C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207.209, 238, 269 and 282; C.I. pigment violet 19; and C.I. vat red 1, 2, 10, 13, 15, 23, 29 and 35.

Examples of dyes for magenta toners include C.I. solvent red 1, 3, 8, 23, 24, 25, 27, 30, 49, 81, 82, 83, 84, 100, 109 and 121; C.I. disper red 9; C.I. solvent violet 8, 13, 14, 21, 27; oil-soluble dyes such as C.I. disperse violet 1, and C.I. basic red 1, 2, 9, 12, 13, 14, 15, 17, 18, 22, 23, 24, 27, 29, 32, 34, 35, 36, 37, 38, 39 and 40; and basic dyes such as C.I. basic violet 1, 3, 7, 10, 14, 15, 21, 25, 26, 27 and 28.

Examples of pigments for cyan toners include C.I. pigment blue 2, 3, 15:2, 15:3, 15:4, 16, and 17; C. I. vat blue 6; and C.I. acid blue 45 and copper phthalocyanine pigments having 1 to 5 phthalimidomethyl substituents in the phthalocyanine framework.

Examples of dyes for cyan toners include C.I. solvent blue 70.

Examples of pigments for yellow toners include C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. vat yellow 1, 3 and 20.

Examples of dyes for yellow toners include C.I. solvent yellow 162.

The content of the colorant is preferably from 0.1 to 30.0 mass parts per 100 mass parts of the binder resin.

Release Agent

The toner particle may include a wax as a release agent. Examples of such a wax are presented hereinbelow.

Hydrocarbon waxes such as low-molecular-weight polyethylene, low-molecular-weight polypropylene, alkylene copolymers, microcrystalline wax, paraffin wax, Fischer-Tropsch wax, and the like; oxides of hydrocarbon waxes, such as oxidized polyethylene wax, or block copolymer thereof; waxes based on fatty acid esters such as carnauba wax; and partially or entirely deoxidized fatty acid esters such as deoxidized carnauba wax. Saturated linear fatty acids such as palmitic acid, stearic acid, and montanic acid; unsaturated fatty acids such as brashidic acid, eleostearic acid, and valinaric acid; saturated alcohols such as stearyl alcohol, aralkyl alcohol, behenyl alcohol, carnaubyl alcohol, ceryl alcohol, and myricyl alcohol; polyhydric alcohols such as sorbitol; esters of fatty acids such as palmitic acid, stearic acid, behenic acid, and montanic acid with alcohols such as stearyl alcohol, aralkyl alcohol, behenyl alcohol, carnaubyl alcohol, ceryl alcohol, and myricyl alcohol; fatty acid amides such as linoleic acid amide, oleic acid amide and lauric acid amide; saturated fatty acid bisamides such as methylene bis-stearic acid amide, ethylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyl adipic acid amide, and N,N'-dioleyl sebacic acid amide; aromatic bisamides such as m-xylene bis-stearic acid amide and N,N'-distearyl isophthalic acid amide; aliphatic metal salts such as calcium stearate, calcium laurate, zinc stearate, and magnesium stearate (generally referred to as metal soaps); waxes obtained by grafting vinyl monomers such as styrene and acrylic acid onto aliphatic hydrocarbon waxes; partial esterification products of fatty acids and polyhydric alcohols such as monoglyceride behenate; and methyl ester compounds having a hydroxyl group obtained by hydrogenation of vegetable fats and oils.

The content of the wax is preferably 2.0 to 30.0 mass parts per 100 mass parts of the binder resin.

Charge Control Agent

The toner particle may optionally include a charge control agent.

As the charge control agent, known ones can be used, but in particular, metal compounds of aromatic carboxylic acids which are colorless, can accelerate the charging speed of the toner and can stably hold a constant charge quantity are preferable.

Examples of negatively charging control agents include metal compounds of salicylic acid, metal compounds of naphthoic acid, metal compounds of dicarboxylic acids, polymeric compounds having a sulfonic acid or a carboxylic acid in a side chain, polymeric compounds having a sulfonic acid salt or a sulfonic acid ester compound in a side chain, polymeric compounds having a carboxylic acid salt or a carboxylic acid ester compound in a side chain, boron compounds, urea compounds, silicon compounds, and calixarenes.

The charge control agent may be internally or externally added to the toner particle. The amount of the charge control agent is preferably 0.2 mass parts to 10 mass parts with respect to 100 mass parts of the binder resin.

Inorganic Fine Particle

The toner may include inorganic fine particles, if necessary.

The inorganic fine particle may be internally added to the toner particle, or may be mixed with the toner particle as an external additive. Examples of the inorganic fine particles include fine particles such as silica fine particles, titanium oxide fine particles, alumina fine particles or fine particles of complex oxides thereof. Among the inorganic fine particles, silica fine particles and titanium oxide fine particles are preferable from the standpoint of flowability improvement and charge uniformity.

The inorganic fine particles are preferably hydrophobized with a hydrophobizing agent such as a silane compound, silicone oil or a mixture thereof.

A silica fine particle manufactured by any method can be used favorably, including for example a silica fine particle manufactured by a wet method such as a precipitation method or sol-gel method in which silica is obtained by neutralizing sodium silicate, or a dry method such as a Verneuil method or arc method in which silica is obtained in a vapor phase. Of these, a silica fine particle manufactured by a sol-gel method or Verneuil method is desirable because the number-average diameter of the primary particles is easier to control within the desired range.

From the viewpoint of flowability improvement, the inorganic fine particles as the external additive preferably have a specific surface area of 50 $m^2/g$ to 400 $m^2/g$. From the viewpoint of improving the durability stability, the inorganic fine particles as the external additive preferably have a specific surface area of 10 $m^2/g$ to 50 $m^2/g$. In order to ensure both the flowability improvement and the durability stability, inorganic fine particles with the specific surface area in these ranges may be used in combination.

The amount of the external additive is preferably 0.1 parts by mass to 10.0 parts by mass with respect to 100 parts by mass of the toner particles. A known mixer such as a Henschel mixer can be used to mix the toner particles with the external additive.

Developer

The toner can be used as a one-component developer, but to further improve dot reproducibility and supply stable images over the long term, it is preferably mixed with a magnetic carrier and used as a two-component developer.

In other words, this is preferably a two-component developer containing a toner and a magnetic carrier, in which the toner is the toner of present disclosures.

Examples of the magnetic carrier include such well-known materials as iron oxide; metal particles such as iron, lithium, calcium, magnesium, nickel, copper, zinc, cobalt, manganese, chromium, and rare earths, alloy particles thereof, and oxide particles thereof; magnetic bodies such as ferrites; magnetic body-dispersed resin carriers (so-called resin carriers) including the magnetic bodies and a binder resin that holds the magnetic bodies in a dispersed state, and the like.

When the toner is used as a two-component developer by mixing with a magnetic carrier, the mixing ratio of the magnetic carrier at that time is preferably 2% by mass to 15% by mass and more preferably 4% by mass to 13% by mass as the toner concentration in the two-component developer.

In gel permeation chromatography measurement of the tetrahydrofuran-soluble component of the toner, the weight-average molecular weight is given as Mw(A), and the number-average molecular weight as Mn(A).

Mw(A) is preferably 25,000 to 60,000, or more preferably 32,000 to 48,000.

Mw(A)/Mn(A) is preferably 5 to 10, or more preferably 7 to 8.

Mn(A) is preferably 3,000 to 8,500, or more preferably 4,000 to 6,000.

Mw(A) can be controlled by controlling the monomer composition and molecular weight of the binder resin, and the manufacturing conditions.

Mw(A)/Mn(A) can be controlled by controlling the monomer composition and molecular weight of the binder resin, and the manufacturing conditions.

Within these ranges, low-temperature fixability and hot offset resistance are improved. The peak molecular weight in a molecular weight distribution curve obtained by GPC measurement of the THF-soluble component of the toner particle is preferably from 7,000 to 11,000, or more preferably from 8,200 to 10,500.

If the peak molecular weight is within this range, low-temperature fixability and hot offset resistance are improved.

When the molecular weight distribution curve has multiple peaks, the peak molecular weight in a molecular weight distribution curve obtained by GPC measurement of the THF-soluble component of the toner particle is the molecular weight of the highest peak.

Toner Manufacturing Method

The method for manufacturing the toner of these disclosures is not particularly limited, and a known method such as a pulverization method, suspension polymerization method, dissolution suspension method, emulsion aggregation method or dispersion polymerization method may be used.

The toner here is preferably manufactured by the methods described below. That is, the toner is preferably manufactured by an emulsion aggregation method. With an emulsion aggregation method, it is easy to form an ideal domain-matrix structure in the toner.

A method for manufacturing a toner, the method comprising:

a step of preparing a resin fine particle dispersion containing a binder resin;

a step of adding a flocculant to the resin fine particle dispersion to form aggregate particles; and a step of heating and fusing the aggregate particles to obtain a dispersion containing a toner particle, wherein the binder resin contains a first resin and a second resin, the first resin is a crystalline resin, the second resin is an amorphous resin, the first resin has a first monomer unit represented by formula (1), a content ratio of the first monomer unit in the first resin is 30.0 mass % to 99.9 mass %, an acid value of the first resin is 0.1 mg KOH/g to 30 mg KOH/g, an acid value of the second resin is 0.5 mg KOH/g to 40 mg KOH/g.

a domain-matrix structure formed of a matrix containing the first resin and domains containing the second resin appears in cross-sectional observation of the toner, the toner particle contains a multivalent metal element, the multivalent metal element is at least one metal element selected from the group consisting of Mg, Ca, Al, Fe and Zn, and a total content of the multivalent metal element is 0.0025 mass parts to 3.0000 mass parts per 100 mass parts of the binder resin:

In the method, the flocculant is preferably a metal salt containing at least one metal element selected from the group consisting of Mg, Ca, Al, Fe and Zn.

Emulsion Aggregation Method

In the emulsion aggregation method, an aqueous dispersion solution of fine particles which are sufficiently smaller than the desired particle size and consist of a constituent material of toner particles is prepared in advance, the fine particles are aggregate to the particle size of toner particles in an aqueous medium, and the resin is fused by heating or the like to produce toner particles.

That is, in the emulsion aggregation method, toner particles are produced through a dispersion step of preparing a fine particle-dispersed solution consisting of the constituent material of the toner particles, an aggregation step of aggregating the fine particles consisting of the constituent material of the toner particles, and controlling the particle diameter until the particle diameter of the toner particles is obtained, a fusion step of fusing the resin contained in the obtained aggregated particles, a subsequent cooling step, a metal removal step of filtering off the obtained toner and removing excess multivalent metal ions, a filtration and washing step of washing with ion exchanged water or the like, and a step of removing moisture of the washed toner particles and drying.

Step of Preparing Resin Fine Particle-Dispersed Solution (Dispersion Step)

The resin fine particle-dispersed solution can be prepared by known methods, but is not limited to these methods. Examples of the known methods include an emulsion polymerization method, a self-emulsification method, a phase inversion emulsification method of emulsifying a resin by adding an aqueous medium to a resin solution obtained by dissolving the resin in an organic solvent, and a forced emulsification method in which the resin is forcedly emulsified by high-temperature treatment in an aqueous medium, without using an organic solvent.

Specifically, a binder resin is dissolved in an organic solvent that can dissolve the resin, and a surfactant or a basic compound is added. At that time, where the binder resin is a crystalline resin having a melting point, the resin may be dissolved by melting to a temperature higher than the melting point. Subsequently, an aqueous medium is slowly added to precipitate resin fine particles while stirring with a homogenizer or the like. Thereafter, the solvent is removed by heating or depressurizing to prepare a resin fine particle-dispersed aqueous solution. Any organic solvent that can dissolve the resin can be used as the organic solvent for dissolving the resin, but an organic solvent which forms a homogeneous phase with water, such as toluene, is preferable from the viewpoint of suppressing the generation of coarse powder.

A surfactant to be used at the time of the emulsification is not particularly limited, and examples thereof include anionic surfactants such as sulfuric acid esters, sulfonic acid salts, carboxylic acid salts, phosphoric acid esters, soaps and the like; cationic surfactants such as amine salts, quaternary ammonium salts and the like; and nonionic surfactants such as polyethylene glycol, alkylphenol ethylene oxide adducts, polyhydric alcohols and the like. The surfactants may be used singly or in combination of two or more thereof.

Examples of the basic compound to be used in the dispersion step include inorganic bases such as sodium hydroxide, potassium hydroxide and the like, and organic bases such as ammonia, triethylamine, trimethylamine, dimethylaminoethanol, diethylaminoethanol and the like. The basic compounds may be used singly or in combination of two or more thereof.

The 50% particle diameter (D50), based on the volume distribution, of the fine particles of the binder resin in the resin fine particle-dispersed aqueous solution is preferably 0.05 μm to 1.0 μm, and more preferably 0.05 μm to 0.4 μm. By adjusting the 50% particle diameter (D50) based on the volume distribution to the above range, it is easy to obtain toner particles with a volume average particle diameter of 3 μm to 10 μm which is suitable for toner particles.

A dynamic light scattering type particle size distribution analyzer NANOTRAC UPA-EX150 (manufactured by Nikkiso Co., Ltd.) is used for measurement of the 50% particle size (D50) based on the volume distribution.

Colorant Fine Particle-Dispersed Solution

The colorant fine particle-dispersed solution, which is used as necessary, can be prepared by the known methods listed below, but is not limited to these methods.

The colorant fine particle-dispersed solution can be prepared by mixing a colorant, an aqueous medium and a dispersing agent by using a mixer such as a known stirrer, emulsifier, and disperser. The dispersing agent used here may be a known one such as a surfactant and a polymer dispersing agent.

Although any of the surfactant and the polymer dispersing agent can be removed in the washing step described hereinbelow, the surfactant is preferable from the viewpoint of washing efficiency.

Examples of the surfactant include anionic surfactants such as sulfuric acid esters, sulfonic acid salts, carboxylic acid salts, phosphoric acid esters, soaps and the like; cationic surfactants such as amine salts, quaternary ammonium salts and the like; and nonionic surfactants such as polyethylene glycol, alkylphenol ethylene oxide adducts, polyhydric alcohols and the like.

Among these, nonionic surfactants and anionic surfactants are preferable. Moreover, a nonionic surfactant and an anionic surfactant may be used together. The surfactants may be used singly or in combination of two or more thereof. The concentration of the surfactant in the aqueous medium is preferably 0.5% by mass to 5% by mass.

The amount of the colorant fine particles in the colorant fine particle-dispersed solution is not particularly limited, but is preferably 1% by mass to 30% by mass with respect to the total mass of the colorant fine particle-dispersed solution.

In addition, from the viewpoint of dispersibility of the colorant in the finally obtained toner, the dispersed particle diameter of the colorant fine particles in the colorant fine particle-dispersed aqueous solution is preferably such that the 50% particle diameter (D50) based on the volume distribution is 0.5 μm or less. Further, for the same reason, it is preferable that the 90% particle size (D90) based on the volume distribution be 2 μm or less. The dispersed particle diameter of the colorant particles dispersed in the aqueous medium is measured by a dynamic light scattering type particle size distribution analyzer (NANOTRAC UPA-EX150: manufactured by Nikkiso Co., Ltd.).

Known mixers such as stirrers, emulsifiers, and dispersers used for dispersing colorants in aqueous media include ultrasonic homogenizers, jet mills, pressure homogenizers, colloid mills, ball mills, sand mills, and paint shakers. These may be used singly or in combination.

Release Agent (Aliphatic Hydrocarbon Compound) Fine Particle-Dispersed Solution

A release agent fine particle-dispersed solution may be used as necessary. The release agent fine particle-dispersed solution can be prepared by the following known methods, but is not limited to these methods.

The release agent fine particle-dispersed solution can be prepared by adding a release agent to an aqueous medium including a surfactant, heating to a temperature equal to or higher than the melting point of the release agent, dispersing to a particulate shape with a homogenizer having a strong shearing ability (for example, "CLEARMIX W MOTION" manufactured by M Technique Co., Ltd.) or a pressure discharge type disperser (for example, a "GAULIN HOMOGENIZER" manufactured by Gaulin Co., Ltd.) and then cooling to below the melting point.

The dispersed particle diameter of the release agent fine particle-dispersed solution in the release agent-dispersed aqueous solution is preferably such that the 50% particle diameter (D50) based on volume distribution is 0.03 μm to 1.0 μm, and more preferably, 0.1 μm to 0.5 μm. In addition, it is preferable that coarse particles of 1 μm or more be not present.

When the dispersed particle diameter of the release agent fine particle-dispersed solution is within the above range, the release agent can be finely dispersed to be present in the toner, the seeping effect at the time of fixing can be maximized, and it is possible to obtain good separability. The dispersed particle diameter of the release agent fine particle-dispersed solution obtained by dispersion in an aqueous medium can be measured with a dynamic light scattering type particle size distribution analyzer (NANOTRAC UPA-EX 150; manufactured by Nikkiso Co., Ltd.).

Mixing Step

In the mixing step, a mixed liquid is prepared by mixing, if necessary, the resin fine particle-dispersed solution with at least one of the release agent fine particle-dispersed solution and the colorant fine particle-dispersed solution. The mixing can be carried out using a known mixing device such as a homogenizer and a mixer.

Step of Forming Aggregated Particles (Aggregation Step)

In the aggregation step, fine particles contained in the mixed liquid prepared in the mixing step are aggregated to form aggregates having a target particle diameter. At this time, a flocculant is added and mixed, and if necessary, at least one of heating and mechanical power is appropriately added to form aggregates in which fine resin particles and, if necessary, at least one of the release agent fine particles and the colorant fine particles are aggregated.

The flocculant is preferably a flocculant including metal ions of a multivalent metal as the multivalent metal element, and the multivalent metal is at least one selected from the group consisting of Mg. Ca, Al, Fe and Zn.

The flocculant including metal ions of the multivalent metal has high aggregating power, and it is possible to achieve the purpose by adding a small amount thereof. Such flocculants can ionically neutralize the ionic surfactant contained in the resin fine particle-dispersed solution, the release agent fine particle-dispersed solution, and the colorant fine particle-dispersed solution. As a result, the binder resin fine particles, the release agent fine particles, and the colorant fine particles are aggregated by the salting out and ionic crosslinking effects. Furthermore, the flocculant including the metal ions of the multivalent metal can form a crosslink with the first resin. As a result, the crosslinking points of the multivalent metal and the polar portion of the toner particle can be formed in a network shape throughout the toner particle while forming a domain matrix structure. Therefore, excellent charge retention property can be demonstrated without impairing the low-temperature fixability.

Examples of flocculants containing metal ions of multivalent metals include metal salts of multivalent metal elements or polymers of metal salts. Specific examples include divalent inorganic metal salts such as calcium chloride, calcium nitrate, magnesium chloride, magnesium sulfate and zinc chloride. Other examples include trivalent metal salts such as iron (III) chloride, iron (III) sulfate, aluminum sulfate and aluminum chloride. Other examples include, but are not limited to, inorganic metal salt polymers such as ferric polysulfate, aluminum polychloride, aluminum polyhydroxide and calcium polysulfate. One of these alone or a combination of at least two may be used.

Of these flocculants, a magnesium flocculant is preferred for its strong crosslinking effect with the binder resin and dispersion effect on the second resin.

The flocculant may be added in the form of a dry powder or an aqueous solution obtained by dissolving in an aqueous medium, but in order to cause uniform aggregation, the flocculant is preferably added in the form of an aqueous solution.

Moreover, it is preferable to perform addition and mixing of the flocculant at a temperature equal to or lower than the glass transition temperature or melting point of the resin contained in a mixed liquid. By performing mixing under such temperature condition, the aggregation proceeds relatively uniformly. The mixing of the flocculant into the mixed liquid can be carried out using known mixing devices such as homogenizers and mixers. The aggregation step is a step of forming aggregates of a toner particle size in an aqueous medium. The volume average particle size of the aggregates produced in the aggregation step is preferably 3 μm to 10 μm. The volume average particle diameter can be measured by a particle size distribution analyzer (Coulter Multisizer III; manufactured by Beckman Coulter, Inc.) by the Coulter method.

Step of Obtaining Dispersion Solution Including Toner Particles (Fusion Step)

In the fusion step, an aggregation stopper is added to the dispersion solution including the aggregates obtained in the aggregation step under stirring similar to that in the aggregation step. The aggregation stopper can be exemplified by a chelating agent that stabilizes aggregated particles by partially dissociating the ionic crosslinks between the acidic polar group of the surfactant and the metal ion that is the flocculant and forming a coordination bond with the metal ion. By adding the aggregation stopper, it is possible to control the crosslinking points between the polar portion of the toner particle and the multivalent metal to an optimum amount, so that the excellent effect of hot offset resistance and the excellent charge retention property can be exhibited without impairing the excellent low-temperature fixability.

After the dispersion state of the aggregated particles in the dispersion solution has been stabilized by the action of the aggregation stopper, the aggregated particles are fused by heating to a temperature equal to or higher than the glass transition temperature or melting point of the binder resin.

The chelating agent is not particularly limited as long as it is a known water-soluble chelating agent. Specific examples include hydroxycarboxylic acids such as tartaric acid, citric acid and gluconic acid, and sodium salts thereof; iminodiacid (IDA), nitrilotriacetic acid (NTA), and ethylenediaminetetraacetic acid (EDTA), and sodium salts of these acids.

The chelating agent is coordinated to the metal ion of the flocculant present in the dispersion solution of the aggregated particles, so that the environment in the dispersion solution can be changed from an electrostatically unstable state in which aggregation can easily occur to an electrostatically stable state in which further aggregation is unlikely to occur. As a result, it is possible to suppress further aggregation of the aggregated particles in the dispersion solution and to stabilize the aggregated particles.

The chelating agent is preferably an organic metal salt having a carboxylic acid having a valency of 3 or more, since even small amounts of such chelating agent can be effective and toner particles having a sharp particle size distribution can be obtained.

Further, from the viewpoint of achieving both stabilization from the aggregation state and washing efficiency, the addition amount of the chelating agent is preferably 1 mass part to 30 mass parts and more preferably 2.5 mass parts to 15 mass parts with respect to 100 mass parts of the binder resin. The volume-based 50% particle diameter (D50) of the toner particles is preferably 3 μm to 10 μm.

Cooling Step

If necessary, in the cooling step, the temperature of the dispersion solution including the toner particles obtained in the fusion step can also be reduced to a temperature lower than at least one of the crystallization temperature and glass transition temperature of the binder resin. By cooling to a temperature lower than at least one of the crystallization temperature and glass transition temperature, it is possible to prevent the generation of coarse particles. The specific cooling rate can be 0.1° C./min to 50° C./min.

Metal Removal Step

In the toner manufacturing method, it is desirable to include a metal removal step in which a chelating compound having a chelating function with respect to metal ions is added to a dispersion containing the toner particle to remove at least part of the multivalent metal element and thereby adjust the content of the multivalent metal element. The concentration distribution of the multivalent metal element on the toner particle surface can be controlled by means of the metal removal step. Specifically, the concentration of the multivalent metal element in the toner particle surface layer can be made lower than the concentration of the multivalent metal element in the toner particle interior, resulting in excellent low-temperature fixability, hot offset resistance and charge retention.

The chelating compound is not particularly limited as long as it is a known water-soluble chelating agent, and the chelating agents described above may be used. Because the metal removal ability of a water-soluble chelating agent is extremely sensitive to temperature, the metal removal step is preferably performed at a temperature of 40° C. to 60° C., or more preferably at about 50° C.

Washing Step

If necessary, impurities in the toner particles can be removed by repeating the washing and filtration of the toner particles obtained in the cooling step in the washing step. Specifically, it is preferable to wash the toner particles by using an aqueous solution including a chelating agent such as ethylenediaminetetraacetic acid (EDTA) and a Na salt thereof, and further wash with pure water. By repeating washing with pure water and filtration a plurality of times, metal salts and surfactants in the toner particles can be removed. The number of filtrations is preferably 3 to 20 and more preferably 3 to 10 from the viewpoint of production efficiency.

Drying Step

In the drying step, if necessary, the toner particles obtained in the above step are dried.

External Addition Step

The resulting toner particle may also be used as is as a toner.

In the external addition step, an inorganic particle is externally added as necessary to treat the toner particle obtained in the drying step. Specifically, an inorganic fine particle of silica or the like or a resin particle of a vinyl resin, polyester resin, silicone resin or the like is preferably added by applying shear force in a dry state.

For example, a mixture of the toner particle and inorganic fine particle together with other external additives can be mixed with a mixing apparatus such as a double cone mixer, V mixer, drum mixer, Super mixer, Henschel mixer, Nauta mixer, Mechano Hybrid (Nippon Coke & Engineering Co., Ltd.), Nobilta (Hosokawa Micron Corporation) or the like.

Methods for measuring various physical properties of toner particles and raw materials will be described hereinbelow.

Method for Measuring Amount of Metal Elements in Toner Particle

The amount of metal elements in the toner particle is measured using a multi-element simultaneous ICP emission spectrophotometer Vista-PRO (manufactured by Hitachi High-Tech Science Co., Ltd.).

Sample: 50 mg

Solvent: 6 mL of nitric acid

The above materials are weighed, and decomposition processing is performed using a microwave sample pretreatment device ETHOS UP (manufactured by Milestone General Co., Ltd.).

Temperature: raised from 20° C. to 230° C. and held at 230° C. for 30 min.

The decomposition solution is passed through filter paper (5C), transferred to a 50 mL volumetric flask, and made up to 50 mL with ultrapure water. The amount of multivalent metal elements (such as Mg, Ca, Al, Fe, and Zn) and monovalent metal elements (Na, Li and K) in the toner particle can be quantified by measuring the aqueous solution in the volumetric flask under the following conditions with the multi-element simultaneous ICP emission spectrophotometer Vista-PRO. For quantification of the amount, a calibration curve is prepared using a standard sample of the element to be quantified, and the calculation is performed based on the calibration curve.

Condition: RF power 1.20 kW,

Ar gas: plasma flow 15.0 L/min,

Auxiliary flow: 1.50 L/min,

MFC: 1.50 L/min,

Nevizer Flow: 0.90 L/min,

Pump speed: 15 rpm,

Measurement repetition: 3 times,

Measurement time: 1.0 s (The case of measuring a toner to which inorganic fine particles including at least one metal element selected from the group consisting of Mg, Ca, Al, Fe, and Zn were externally added)

When measuring the amount of metal element in the toner particle of the toner to which inorganic fine particles including at least one metal element selected from the group consisting of Mg, Ca, Al, Fe, and Zn were externally added, the measurement is performed after the inorganic fine particles have been separated from the toner in order to prevent the calculation of the amount of the metal element derived from the inorganic fine particles in addition to the metal element forming the crosslinking with the polar portion. Specifically, the method is as follows.

Separating Inorganic Fine Particle from Toner

The inorganic fine particles can also be separated from the toner by the following methods.

200 g of sucrose (Kishida Chemical) is added to 100 mL of ion-exchanged water, and dissolved in a hot water bath to prepare a concentrated sucrose solution. 31 g of the concentrated sucrose solution and 6 mL of Contaminon N (a 10 mass % aqueous solution of a pH 7 neutral detergent for washing precision instruments, comprising a nonionic surfactant, an anionic surfactant and an organic builder, manufactured by Wako Pure Chemical Industries, Ltd.) are added to a centrifugation tube to prepare a dispersion solution. 1 g of the toner is added to this dispersion solution, and clumps of toner are broken up with a spatula or the like.

The centrifugation tube is shaken for 20 minutes in a shaker (KM Shaker (model: V.SX) IWAKI CO., LTD.) at a rate of 350 passes per minute. After being shaken, the solution is transferred to a glass tube (50 mL) for a swing rotor, and centrifuged under conditions of 3500 rpm, 30 minutes in a centrifuge. Toner particles are present in the uppermost layer inside the glass tube after centrifugation, while inorganic fine particles are present in the aqueous solution of the lower layer. The toner particles in the uppermost layer are collected.

The aqueous solution of the lower layer is collected and centrifuged to separate the sucrose from the inorganic fine particles, and the inorganic fine particles are collected. Centrifugation is repeated as necessary, and once the separation is sufficient, the dispersion is dried, and the inorganic fine particles are collected.

When multiple inorganic fine particles have been added, they can be selected by centrifugation or the like.

When the toner particle contains a magnetic body, further centrifugation is performed under the same conditions. The toner particle is separated in the top layer and the magnetic body in the bottom layer.

Confirming Non-phase Separation State of Multivalent Metal Element

A toner cross-section is observed by the following methods, and if the multivalent metal is not observed, this means that the toner particle contains the multivalent metal element in a non-phase separated state with a particle diameter of not more than 100 nm.

To determine the presence or absence of the multivalent element that is not observed in the toner cross-section, element mapping is performed with an X-ray analyzer (SEM-EDX). The measurement unit is an EDAX energy dispersive X-ray analyzer. The mapped elements are magnesium, aluminum, calcium, iron and zinc.

The mapping conditions are as follows.

Acceleration voltage: 200 kV
Electron beam irradiation size: 1.5 nm
Live time limit: 600 sec
Dead time: 20 to 30
Mapping resolution: 256×256

When a peak occurs in the spectrum of any of the above elements (average of 10 nm square) and the particle diameter in toner cross-section observation is not more than 100 nm, the toner particle is judged to contain the multivalent metal element in a non-phase dispersed state.

Method for Measuring Dielectric Constants

Using a 284A Precision LCR Meter (Hewlett Packard), the complex dielectric constant is measured at a frequency of 2 kHz after calibration at frequencies of 1 kHz and 1 MHz. 39200 kPa (400 kg/cm$^2$) of load is applied for 5 minutes to the sample to be measured, to mold a disc-shaped measurement sample 25 mm in diameter and not more than 1 mm thick (preferably 0.5 to 0.9 mm). This measurement sample is mounted on an ARES (Rheometric Scientific FE) equipped with a dielectric constant measurement jig (electrode) 25 mm in diameter, and measured at a frequency of 2 kHz under 0.49 N (50 g) of load in a 25° C. atmosphere.

Method for Measuring Content Ratio of Each Monomer Unit in First Resin

The content ratio of each monomer unit in the first resin is measured by $^1$H-NMR under the following conditions.

Measurement unit: FT NMR unit JNM-EX400 (JEOL Ltd.)
Measurement frequency: 400 MHz
Pulse condition: 5.0 μs
Frequency range: 10500 Hz
Number of integrations: 64
Measurement temperature: 30° C.
Sample: Prepared by placing 50 mg of the measurement sample in a sample tube with an inner diameter of 5 mm, adding deuterated chloroform ($CDCl_3$) as a solvent, and dissolving this in a thermostatic tank at 40° C.

Of the peaks attributable to constituent elements of the first monomer unit in the resulting $^1$H-NMR chart, a peak independent of peaks attributable to constituent elements of otherwise-derived monomer units is selected, and the integrated value $S_1$ of this peak is calculated.

Similarly, a peak independent of peaks attributable to constituent elements of otherwise-derived monomer units is selected from the peaks attributable to constituent elements of the second monomer unit, and the integrated value $S_2$ of this peak is calculated.

When the first resin contains a third monomer unit, a peak independent of peaks attributable to constituent elements of otherwise-derived monomer units is selected from the peaks attributable to constituent elements of the third monomer unit, and the integrated value $S_3$ of this peak is calculated.

The content of the first monomer unit is determined as follows using the integrated values $S_1$, $S_2$ and $S_3$, $n_1$, $n_2$ and $n_3$ are the numbers of hydrogen atoms in the constituent elements to which the observed peaks are attributed for each segment.

$$\text{Content (mol \%) of the first monomer unit}=\{(S_1/n_1)/((S_1/n_1)+(S_2/n_2)+(S_3/n_3))\}\times 100.$$

The second and third monomer units are determined similarly as shown below.

$$\text{Content (mol \%) of the second monomer unit}=\{(S_2/n_2)/((S_1/n_1)+(S_2/n_2)+(S_3/n_3))\}\times 100.$$

$$\text{Content (mol \%) of the third monomer unit}=\{(S_3/n_3)/((S_1/n_1)+(S_2/n_2)+(S_3/n_3))\}\times 100.$$

When a polymerizable monomer not containing a hydrogen atom in a constituent element other than a vinyl group is used in the first resin, measurement is performed in single pulse mode using $^{13}$C-NMR with $^{13}$C as the measurement nucleus, and the ratio is calculated in the same way as by $^1$H-NMR.

When the toner is manufactured by suspension polymerization, independent peaks may not be observed because the peaks of release agents and other resins overlap. It may thus be impossible to calculate the ratios of the monomer units derived from each of the polymerizable monomers in the first resin. In this case, a first resin 'can be manufactured and analyzed as the first resin by performing similar suspension polymerization without using a release agent or other resin.

Method for Calculating SP Value

SP Value such as $SP_{21}$ are determined as follows following the calculation methods proposed by Fedors.

The evaporation energy (Δei) (cal/mol) and molar volume (Δvi) ($cm^3$/mol) are determined from the tables described in "Polym. Eng. Sci., 14(2), 147-154 (1974)" for the atoms or atomic groups in the molecular structures of each of the polymerizable monomers, and $(4.184\times\Sigma\Delta ei/\Sigma\Delta vi)^{0.5}$ is regarded as the SP value $(J/cm^3)^{0.5}$.

$SP_{21}$ is calculated by similar methods for the atoms or atomic groups in the molecular structures of the same polymerizable monomers with the double bonds cleaved by polymerization.

Method for Measuring Melting Points

The melting points of such as the resin is measured under the following conditions using a DSC Q1000 (TA Instruments).

Ramp rate: 10° C./min

Measurement start temperature: 20° C.

Measurement end temperature: 180° C.

The melting points of indium and zinc are used for temperature correction of the device detection part, and the heat of fusion of indium is used for correction of the calorific value.

Specifically, 5 mg of sample is weighed precisely into an aluminum pan, and subjected to differential scanning calorimetry. An empty silver pan is used for reference.

The peak temperature of the maximum endothermic peak during the first temperature rise is regarded as the melting point.

When multiple peaks are present, the maximum endothermic peak is the peak at which the endothermic quantity is the greatest.

Methods for Measuring Peak Molecular Weight and Weight-Average Molecular Weight of THF-Soluble Component of Resin by GPC The peak molecular weight and weight-average molecular weight (Mw) of the THF-soluble component of a resin such as the first resin or second resin are measured as follows by gel permeation chromatography (GPC).

First, the sample is dissolved in tetrahydrofuran (THF) over the course of 24 hours at room temperature. The resulting solution is filtered through a solvent-resistant membrane filter (Maishori Disk, Tosoh Corp.) having a pore diameter of 0.2 μm to obtain a sample solution. The concentration of THF-soluble components in the sample solution is adjusted to about 0.8 mass %. Measurement is performed under the following conditions using this sample solution.

System: HLC8120 GPC (detector: RI)(Tosoh Corp.)

Columns: Shodex KF-801, 802, 803, 804, 805, 806, 807 (total 7)(Showa Denko)

Eluent: Tetrahydrofuran (THF)

Flow rate: 1.0 mL/min

Oven temperature: 40.0° C.

Sample injection volume: 0.10 mL

A molecular weight calibration curve prepared using standard polystyrene resin (product name: TSK standard polystyrene F-850, F-450, F-288, F-128, F-80, F-40, F-20, F-10, F-4, F-2, F-1, A-5000, A-2500, A-1000, A-500, Tosoh Corp.) is used for calculating the molecular weights of the samples.

Method for Measuring Molecular Weight of THF-Soluble Component of Toner 0.5 mg of the toner to be measured is dissolved in 1 g of THF and ultrasound dispersed, the concentration is then adjusted to 0.5%, and the dissolved component is measured by GPC.

A HLC-8120GPC, SC-8020 (Tosoh) is used as the GPC unit, two TSK gel, Super HM-H columns (Tosoh, 6.0 mm ID×15 cm) as the columns, and THF as the eluent.

For the test conditions, the test is performed at a sample concentration of 0.5%, a flow rate of 0.6 ml/min, a sample injection volume of 10 μl and a measurement temperature of 40° C. using a refractive index (RI) detector.

A calibration curve is also prepared using Tosoh TSK standard polystylene A-500, F-1, F-10, F-80, F-380, A-2500, F-4, F-40, F-128 and F-700 (total 10 samples).

Method for Measuring Softening Point of Resin

The softening point of the resin is measured using a constant load extrusion type capillary rheometer (Shimadzu Corporation, CFT-500D Flowtester flow characteristics evaluation device) in accordance with the attached manual. With this device, the temperature of a measurement sample packed in a cylinder is raised to melt the sample while a fixed load is applied to the measurement sample from above with a piston, the melted measurement sample is extruded through a die at the bottom of the cylinder, and a flow curve can then be obtained showing the relationship between the temperature and the descent of the piston during this process.

In the present invention, the "melting temperature by ½ method" as described in the attached manual of the CFT-500D Flowtester flow characteristics evaluation device is given as the softening point.

The melting temperature by the ½ method is calculated as follows.

Half of the difference between the descent of the piston upon completion of outflow (outflow end point, given as "Smax") and the descent of piston at the beginning of outflow (minimum point, given as "Smin") is determined and given as X (X=(Smax−Smin)/2). The temperature in the flow curve at which the descent of the piston is the sum of X and Smin is the melting temperature by the ½ method.

For the measurement sample, about 1.0 g of resin is compression molded for about 60 seconds at about 10 MPa with a tablet molding compressor (such as NPa Systems Co., Ltd., NT-100H) in a 25° C. environment to obtain a cylindrical sample about 8 mm in diameter.

The specific operations for measurement are performed in accordance with the device manual.

The CFT-500D measurement conditions are as follows.

Test mode: Temperature increase method

Initial temperature: 50° C.

Achieved temperature: 200° C.

Measurement interval: 1.0° C.

Ramp rate: 4.0° C./min

Piston cross-sectional area: 1.000 $cm^2$

Test load (piston load): 10.0 kgf (0.9807 MPa)

Pre-heating time: 300 seconds

Die hole diameter: 1.0 mm

Die length: 1.0 mm

Measuring Glass Transition Temperature (Tg) of Resin

The glass transition temperature (Tg) is measured in accordance with ASTM D3418-82 using a differential scanning calorimeter (TA Instruments, Q2000).

The melting points of indium and zinc are used for temperature correction of the device detection part, and the fusion heat of indium is used to correct the calorimetric value.

Specifically, 3 mg of sample is weighed exactly, placed in an aluminum pan, and measured under the following conditions using an empty aluminum pan for reference.

Ramp rate: 10° C./min

Measurement start temperature: 30° C.

Measurement end temperature: 180° C.

During measurement, the temperature is first raised to 180° C. and maintained for 10 minutes, then lowered to 30° C. at a rate of 10° C./min, and then raised again. A specific heat change is obtained in the temperature range of 30° C. to 100° C. during this second temperature rise. The glass transition temperature (Tg) is the point of intersection between the differential thermal curve and a line intermediate between the baselines before and after the appearance of the specific heat change.

Method for Measuring Acid Value (Av) of Polymer a and Amorphous Resin Other than Polymer A The acid value is the number of milligrams of potassium hydroxide required to neutralize the acid component such as a free fatty acid, a resin acid and the like contained in 1 g of the sample. The acid value is measured according to JIS K 0070-1992.

(1) Reagent

A total of 1.0 g of phenolphthalein is dissolved in 90 mL of ethyl alcohol (95% by volume), and ion-exchanged water is added to make it 100 mL and obtain a phenolphthalein solution.

A total of 7 g of special grade potassium hydroxide is dissolved in 5 mL of water, and ethyl alcohol (95% by volume) is added to make 1 L. The solution is placed in an alkali-resistant container and allowed to stand for 3 days, while preventing contact with carbon dioxide gas and the like, and filtration is thereafter performed to obtain a potassium hydroxide solution. The obtained potassium hydroxide solution is stored in an alkali resistant container. A total of 25 mL of 0.1 mol/L hydrochloric acid is placed in an Erlenmeyer flask, several drops of the phenolphthalein solution are added thereto, titration is performed with the potassium hydroxide solution, and the factor of the potassium hydroxide solution is determine from the amount of the potassium hydroxide solution required for neutralization. The 0.1 mol/L hydrochloric acid prepared according to JIS K 8001-1998 is used.

(2) Operation (A) Main Test

A total of 2.0 g of the ground sample is accurately weighed into a 200 mL Erlenmeyer flask, 100 mL of a mixed solution of toluene/ethanol (2:1) is added, and dissolution is performed for 5 h. Subsequently, several drops of the phenolphthalein solution are added as an indicator, and titration is performed using the potassium hydroxide solution. The end point of titration is assumed to be when the pale pink color of the indicator lasts for about 30 sec.

(B) Blank Test

Titration is performed in the same manner as described hereinabove except that no sample is used (that is, only a mixed solution of toluene/ethanol (2:1) is used).

(3) The obtained result is substituted into the following formula to calculate the acid value.

$$A=[(C-B)\times f\times 5.61]/S$$

Here, A: acid value (mg KOH/g), B: addition amount (mL) of the potassium hydroxide solution in the blank test, C: addition amount (mL) of the potassium hydroxide solution in the main test, f: factor of potassium hydroxide solution, S: mass of the sample (g).

Method for Measuring Weight Average Particle Diameter (D4) of Toner

The weight average particle diameter (D4) of the toner (or toner particle) is calculated in the following manner. A precision particle size distribution measuring apparatus (registered trademark, "Coulter Counter Multisizer 3", manufactured by Beckman Coulter, Inc.) based on a pore electric resistance method and equipped with an aperture tube having a diameter of 100 μm is used as a measurement apparatus. The dedicated software "Beckman Coulter Multisizer 3 Version 3.51" (manufactured by Beckman Coulter, Inc.), which is provided with the apparatus, is used to set the measurement conditions and analyze the measurement data. The measurement is performed with 25,000 effective measurement channels A solution prepared by dissolving special grade sodium chloride in ion exchanged water to a concentration of about 1% by mass, for example, "ISOTON II" manufactured by Beckman Coulter, Inc., can be used as the electrolytic aqueous solution to be used for measurements.

The dedicated software is set up in the following manner before the measurement and analysis.

The total count number in a control mode is set to 50000 particles on a "CHANGE STANDARD OBSERVATION METHOD (SOM)" screen of the dedicated software, the number of measurements is set to 1, and a value obtained using "standard particles 10.0 μm" (manufactured by Beckman Coulter, Inc.) is set as a Kd value. The threshold and the noise level are automatically set by pressing a "THRESHOLD/NOISE LEVEL MEASUREMENT" button. Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE" function of the dedicated software.

(2) A total of about 30 mL of the electrolytic aqueous solution is placed in a glass 100 mL flat-bottom beaker. Then, about 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of 3.3 L of ion exchanged water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) A total of 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 0° C. to 40° C.

(6) The electrolytic aqueous solution of (5) hereinabove in which the toner is dispersed is dropped using a pipette into the round bottom beaker of (1) hereinabove which has been set in the sample stand, and the measurement concentration is adjusted to be about 5%. Then, measurement is conducted until the number of particles to be measured reaches 50000.

(7) The measurement data are analyzed with the dedicated software provided with the apparatus, and the weight average particle diameter (14) is calculated. The "AVERAGE DIAMETER" on the "ANALYSIS/VOLUME STATISTICAL VALUE (ARITHMETIC MEAN)" screen when the special software is set to graph/volume % is the weight average particle diameter (D4).

Method for Measuring Average Circularity of Toner

The average circularity of the toner is measured by a flow type particle image analyzer "FPIA-3000" (manufactured by Sysmex Corporation) under the measurement and analysis conditions at the time of calibration.

The measurement principle of the flow type particle image analyzer "FPIA-3000" (manufactured by Sysmex Corporation) is to capture an image of flowing particles as a still image and perform image analysis. The sample added to a sample chamber is fed to a flat sheath flow cell by a sample suction syringe. The sample fed into the flat sheath flow is sandwiched by the sheath liquid to form a flat flow. The sample passing through the flat sheath flow cell is irradiated with strobe light at intervals of 1/60 see, and the image of flowing particles can be captured as a still image. Further, since the flow is flat, the image is captured in focus. The particle image is captured by a CCD camera, and the captured image is subjected to image processing with an image processing resolution of 512×512 pixels (0.37×0.37 μm per pixel), the outline of each particle image is extracted, and a projected area S, a perimeter L and the like of the particle image are measured.

Next, a circle-equivalent diameter and a circularity are determined using the area S and the perimeter L. The circle-equivalent diameter is the diameter of a circle having the same area as the projected area of the particle image, and the circularity C is determined as a value obtained by dividing the perimeter of the circle determined from the circle-equivalent diameter by the perimeter of the particle projection image. The circularity is calculated by the following formula.

$$\text{Circularity } C=2\times(\pi\times S)^{1/2}/L$$

When the particle image is circular, the circularity is 1.000, and the circularity assumes a smaller value as the degree of unevenness on the periphery of the particle image increases. After calculating the circularity of each particle, the range of circularity of from 0.200 to 1.000 is divided into 800, the arithmetic mean value of the circularities obtained is calculated, and this value is defined as the average circularity.

The specific measurement method is described hereinbelow.

First, about 20 mL of ion exchanged water from which solid impurities and the like have been removed in advance is placed in a glass container. About 0.2 mL of a diluent prepared by diluting "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with about three-fold mass of ion exchanged water is added as a dispersing agent thereto.

Further, about 0.02 g of a measurement sample is added, and dispersion treatment is performed for 2 min using an ultrasonic wave disperser to obtain a dispersion for measurement. At that time, the dispersion solution is suitably cooled to a temperature of 10° C. to 40° C. As the ultrasonic wave disperser, a table-top type ultrasonic cleaner disperser ("VS-150" (manufactured by VELVO-CLEAR Co.)) having an oscillation frequency of 50 kHz and an electric output of 150 W is used, a predetermined amount of ion exchanged water is placed into a water tank, and about 2 mL of the CONTAMINON N is added to the water tank.

For measurement, the flow type particle image analyzer equipped with a standard objective lens (×10) is used, and a particle sheath "PSE-900A" (manufactured by Sysmex Corporation) is used as a sheath liquid. The dispersion solution prepared according to the procedure is introduced into the flow type particle image analyzer, and 3,000 toner particles are measured in a total count mode in an HPF measurement mode.

Then, the binarization threshold value at the time of particle analysis is set to 85%, the particle diameter to be analyzed is set to a circle-equivalent diameter of 1.98 μm to 39.96 μm, and the average circularity of the toner is obtained.

In the measurement, automatic focusing is performed using standard latex particles (for example, "RESEARCH AND TEST PARTICLES Latex Microsphere Suspensions 5200A" manufactured by Duke Scientific Inc. which are diluted with ion exchanged water) before the start of the measurement. After that, it is preferable to perform focusing every 2 h from the start of the measurement.

Methods for Measuring Volume-Based 50% Particle Diameters (D50) of Crystalline Resin Fine Particle, Amorphous Resin Fine Particle, Aliphatic Hydrocarbon Compound Fine Particle and Colorant Fine Particle A dynamic light scattering type particle size distribution meter NANOTRAC UPA-EX150 (manufactured by Nikkiso Co., Ltd.) is used for measuring the 50% particle size (D50), based on volume distribution, of crystalline resin fine particles, amorphous resin fine particles, aliphatic hydrocarbon compound fine particles, and colorant fine particles. Specifically, the measurement is performed according to the following procedure.

In order to prevent aggregation of the measurement sample, the dispersion solution in which the measurement sample is dispersed is introduced into an aqueous solution including FAMILY FRESH (manufactured by Kao Corporation) and stirred. After stirring, the measurement sample is injected into the abovementioned device, the measurement is performed twice, and the average value is determined.

As the measurement conditions, the measurement time is 30 sec. the sample particle refractive index is 1.49, the dispersion medium is water, and the dispersion medium refractive index is 1.33.

The volume particle size distribution of the measurement sample is measured, and the particle diameter at which the cumulative volume from the small particle diameter side in the cumulative volume distribution from the measurement results is 50% is taken as the 50% particle diameter (D50), based on the volume distribution, of each particle.

Method for Measuring Complex Elastic Modulus of Toner

A rotating plate type rheometer "ARES" (manufactured by TA INSTRUMENTS) is used as a measurement device.

A sample obtained by pressure-molding the toner in a disk shape having a diameter of 25 mm and a thickness of 2.0±0.3 mm by using a tablet molding machine under an environment of 25° C. is used as a measurement sample.

The sample is mounted on a parallel plate, and the temperature is raised from room temperature (25° C.) to 110° C. over 15 min to adjust the shape of the sample, followed by cooling to the measurement start temperature of the viscoelasticity. The measurement is then started and a complex viscosity is measured. At this time, the measurement sample is set so that the initial normal force becomes zero. Also, in the subsequent measurement, it is possible to cancel the influence of the normal force by performing the automatic tension adjustment (Auto Tension Adjustment ON) as described below.

The measurement is performed under the following conditions.

(1) A parallel plate having a diameter of 25 mm is used.

(2) The frequency is set to 6.28 rad/sec (1.0 Hz).

(3) The applied strain initial value (Strain) is set to 1.0%.

(4) The measurement is performed at a Ramp Rate of 2.0° C./min between 40° C. and 100° C. In the measurement, the following setting conditions of the automatic adjustment mode are used. The measurement is performed in the automatic strain adjustment mode (Auto Strain).

(5) The Max Applied Strain is set to 40.0%.

(6) The Max Allowed Torque is set to 150.0 g·cm, and the Min Allowed Torque is set to 0.2 g·cm.

(7) The Strain Adjustment is set to 20.0% of Current Strain. In the measurement, the automatic tension adjustment mode (Auto Tension) is used.

(8) The Auto Tension Direction is set as Compression.

(9) The Initial Static Force is set to 10.0 g, and the Auto Tension Sensitivity is set to 40.0 g.

(10) As the operation condition of the Auto Tension, a Sample Modulus is $1.0\times10^3$ Pa or more.

Methods for Observing Toner Cross-Section and Analyzing Matrix and Domains

Sections are first prepared as reference samples of abundance.

The first resin (crystalline resin) is first thoroughly dispersed in a visible light curable resin (Aronix LCR Series D800) and cured by exposure to short wavelength light. The resulting cured resin is cut with an ultramicrotome equipped with a diamond knife to prepare a 250 nm sample section. A sample of the second resin (amorphous resin) is prepared in the same way.

The first resin and second resin are mixed at ratios of 0/100, 30/70, 70/30 and 0/100, and melt kneaded to prepare kneaded mixture& These are similarly dispersed in visible light curable resin and cut to prepare sample sections.

Next, these reference samples are observed in cross-section by TEM-EDX using a transmission electron microscope (JEOL Ltd., JEM-2800 electron microscope), and element mapping is performed by EDX. The mapped elements are carbon, oxygen and nitrogen.

The mapping conditions are as follows.

Acceleration voltage: 200 kV

Electron beam exposure size: 1.5 nm

Live time limit: 600 sec

Dead time: 20 to 30

Mapping resolution: 256×256

(Oxygen element intensity/carbon element intensity) and (nitrogen element intensity/carbon element intensity) are calculated based on the spectral intensities of each element (average in 10 nm-square area), and calibration curves are prepared for the mass ratios of the first and second resin. When the monomer units of the first resin contain nitrogen, the subsequent assay is performed using the (nitrogen element intensity/carbon element intensity) calibration curve.

The toner samples are then analyzed.

The toner is first thoroughly dispersed in a visible light curable resin (Aronix LCR Series D800) and cured by exposure to short wavelength light. The resulting cured resin is cut with an ultramicrotome equipped with a diamond knife to prepare a 250 nm sample section. The cut sample is then observed by TEM-EDX using a transmission electron microscope (JEOL Ltd., JEM-2800 electron microscope). A cross-sectional image of the toner particle is obtained, and element mapping is performed by EDX. The mapped elements are carbon, oxygen and nitrogen.

Toner cross-sections for observation are selected as follows. The cross-sectional area of the toner is first determined from the cross-sectional image, and the diameter of a circle having the same area as the cross-sectional area (circle equivalent diameter) is determined. Observation is limited to toner cross-section images in which the absolute value of the difference between the circle equivalent diameter and the weight-average particle diameter (D4) is within 1.0 μm.

For the domains confirmed in the observed image, (oxygen element intensity/carbon element intensity) and/or (nitrogen element intensity/carbon element intensity) are calculated based on the spectrum intensities of each element (average of 10 nm square), and the ratios of the first and second resins are calculated based on a comparison with the calibration curves. A domain in which the ratio of the second resin is at least 80% is considered a domain in the present disclosure.

The domains confirmed in the observed image are specified and binarized to determine the particle diameter of the domains present in the toner cross-section. The particle diameter is given as the domain diameter. This is measured at 10 points in each toner, and the calculated average for the domains of 10 toners is given as the number-average diameter. Image Pro PLUS (Nippon Roper K. K.) is used for binarization.

Method for Separating Materials from Toner

Each of the materials contained in the toner can be separated from the toner using the differences among the materials in solubility in solvents.

First separation: The toner is dissolved in 23° C. methyl ethyl ketone (MEK), and the soluble component (second resin) is separated from the insoluble components (first resin, release agent, colorant, inorganic fine particle, etc.).

Second separation: The insoluble components obtained in the first separation (first resin, release agent, colorant, inorganic fine particle, etc.) are dissolved in 100° C. MEK, and the soluble components (first resin, release agent) are separated from the insoluble components (colorant, inorganic fine particle, etc.).

Third separation: The soluble components (first resin, release agent) obtained in the second separation are dissolved in 23° C. chloroform and separated into a soluble component (first resin) and an insoluble component (release agent).

When a Third Resin is Included

First separation: The toner is dissolved in 23° C. methyl ethyl ketone (MEK), and the soluble components (second resin, third resin) are separated from the insoluble components (first resin, release agent, colorant, inorganic fine particle, etc.).

Second separation: The soluble components (second resin, third resin) obtained in the first separation are dissolved in 23° C. toluene and separated into a soluble component (third resin) and an insoluble component (second resin).

Third separation: The insoluble components (first resin, release agent, colorant, inorganic fine particle, etc.) obtained in the first separation are dissolved in 100° C. MEK and separated into soluble components (first resin, release agent) and insoluble components (colorant, inorganic fine particle, etc.).

Fourth separation: The soluble components (first resin, release agent) obtained in the third separation are dissolved in 23° C. chloroform and separated into a soluble component (first resin) and an insoluble component (release agent).

Measuring Contents of First Resin and Second Resin in Binder Resin in Toner

The masses of the soluble components and insoluble components obtained in the separation steps above are measured to calculate the contents of the first resin and second resin in the binder resin in the toner.

EXAMPLES

The present invention is explained using the examples below. However, these do not in any way limit the present invention. Unless otherwise specified, parts in the formulations below are based on mass.

Manufacturing Example of Crystalline Resin C1

Solvent: Toluene 100.0 parts

Monomer composition: 100.0 parts (Monomer composition is a mixture of the following behenyl acrylate, methacrylonitrile, styrene and acrylic acid in the following proportions)

(Behenyl acrylate (1st polymerizable monomer): 67.0 parts (28.9 mol %))

(Methacrylonitrile (2nd polymerizable monomer): 21.5 parts (52.7 mol %))

(Styrene (3rd polymerizable monomer): 11.0 parts (17.3 mol %))

(Acrylic acid: 0.5 parts (1.1 mol %))

Polymerization initiator: t-butyl peroxypivalate (NOF Corp. Perbutyl PV) 0.5 parts These materials were placed in a nitrogen atmosphere in a reaction vessel equipped with a reflux condenser, a stirrer, a thermometer and a nitrogen introduction pipe. The inside of the reaction vessel was stirred at 200 rpm as the mixture was heated to 70° C. and a polymerization reaction was performed for 12 hours, to obtain a solution of a polymer of the monomer composition dissolved in toluene. Next, the solution was cooled to 25° C. and then added under stirring to 1000.0 parts of methanol, and a methanol-insoluble component was precipitated. The resulting methanol-insoluble component was filtered out, washed with methanol, and vacuum dried for 24 hours at 40° C. to obtain a crystalline resin C1. The crystalline resin C1 had a weight-average molecular weight of 68400, a melting point of 62° C. and an acid value of 10 mg KOH/g.

In NMR analysis, the crystalline resin C1 contained 28.9 mol % of a monomer unit derived from behenyl acrylate, 53.8 mol % of a monomer unit derived from methacrylonitrile and 17.3 mol % of a monomer unit derived from styrene. The content ratio of the first monomer unit was 67.0 mass %.

The SP value of the monomer unit derived from the second polymerizable monomer was 29.13 $(J/cm^3)^{0.5}$.

Manufacturing Example of Crystalline Resin C2

470 parts of toluene were placed in an autoclave, nitrogen was substituted, and the temperature was raised to 105° C. in a sealed state under stirring. A mixture of 500 parts of behenyl acrylate (C22), 250 parts of styrene, 250 parts of acrylonitrile, 20 parts of methacrylic acid, 5 parts of alkylallyl sulfosuccinic sodium salt, 19 parts of 2-isocyanatoethyl methacrylate, 3.7 parts of t-butylperoxy-2-ethylhexanoate and 240 parts of toluene was dripped in and polymerized over the course of 2 hours with the internal temperature of the autoclave controlled at 105° C.

The same temperature was maintained for a further 4 hours to complete the reaction, after which 16 parts of di-normal butylamine and 5 parts of bismuth catalyst (Nitto Kasei Co., Ltd., Neostann U-600) were added, and the mixture was reacted for 6 hours at 90° C. The solvent was then removed at 100° C. to obtain a crystalline resin C2. The crystalline resin C2 had a weight-average molecular weight of 100000, a melting point of 46° C. and an acid value of 10 mg KOH/g. The content ratio of the first monomer unit was 49.0 mass %.

The SP value of the monomer unit derived from acrylonitrile was 22.75 $(J/cm^3)^{0.5}$.

Manufacturing Example of Crystalline Resin C3

138 parts of xylene were placed in an autoclave, nitrogen was substituted, and the temperature was raised to 170° C. in a sealed state under stirring. A mixed solution of 200 parts of behenyl acrylate (C22), 150 parts of styrene, 300 parts of acrylonitrile, 600 parts of vinyl acetate, 1.5 parts of di-t-butyl peroxide and 100 parts of xylene was dripped in and polymerized over the course of 3 hours with the internal temperature of the autoclave controlled at 170° C.

After dripping, the drip line was washed with 12 parts of xylene. This was then maintained at the same temperature for 4 hours to complete polymerization. The solvent was removed for 3 hours at 100° C. under reduced pressure of 0.5 to 2.5 kPa to obtain a crystalline resin C3.

The crystalline resin C3 had a weight-average molecular weight of 45000, a melting point of 60° C., and an acid value of 10 mg KOH/g. The content ratio of the first monomer unit was 23.5 mass %.

The SP value of the monomer unit derived from vinyl acetate was 18.31 $(J/cm^3)^{0.5}$.

Manufacturing Example of Crystalline Resin C4

Dodecanediol: 34.5 parts (0.29 moles; 100.0 mol % relative to total moles of polyhydric alcohol)

Sebacic acid: 65.5 parts (0.28 moles; 100.0 mol % relative to total moles of polyvalent carboxylic acid)

These materials were weighed into a reaction tank equipped with a cooling pipe, a stirrer, a nitrogen introduction pipe and a thermocouple. The flask was then purged with nitrogen gas, the temperature was gradually raised under stirring, and the mixture was stirred at 140° C. while beings reacted for 3 hours.

Tin 2-ethylhexanoate: 0.5 parts

This material was then added, the pressure inside the reaction vessel was lowered to 8.3 kPa, and the mixture was reacted for 4 hours with the temperature maintained at 200° C., after which the reaction vessel was gradually opened to return the pressure to normal pressure and obtain a crystalline resin C4. The crystalline resin C4 had a weight-average molecular weight of 30000, a melting point of 50° C., and an acid value of 10 mg KOH/g. The content ratio of the first monomer unit was 0 mass %.

Manufacturing Example of Crystalline Resin C5

138 parts of xylene were placed in an autoclave, which was then purged with nitrogen, after which the temperature was raised to 170° C. under stirring in a sealed state. A mixed solution of 450 parts of behenyl acrylate (C22), 150 parts of styrene, 150 parts of acrylonitrile, 1.5 parts of di-t-butyl peroxide and 100 pars of xylene was dripped in and polymerized over the course of 3 hours with the internal temperature of the autoclave controlled at 170° C.

After dripping, the drip line was washed with 12 parts of xylene. This was then maintained at the same temperature for 4 hours to complete polymerization. The solvent was removed for 3 hours at 100° C. under reduced pressure of 0.5 to 2.5 kPa to obtain a crystalline resin C5.

The crystalline resin C5 had a weight-average molecular weight of 14000, a melting point of 60° C., and an acid value of 0 mg KOH/g. The content ratio of the first monomer unit was 60.0 mass %.

The SP value of the monomer unit derived from acrylonitrile was 22.75 $(J/cm^3)^{0.5}$.

Manufacturing Example of Crystalline Resin C6

A crystalline resin C6 was obtained as in the manufacturing example of the crystalline resin C3 except that the amount of behenyl acrylate (C22) was changed to 500 parts.

The crystalline resin C6 had a weight-average molecular weight of 46000, a melting point of 55° C., and an acid value of 8 mg KOH/g. The content ratio of the first monomer unit was 32.3 mass %.

Manufacturing Example of Crystalline Resin C7

A crystalline resin C7 was obtained as in the manufacturing example of the crystalline resin C3 except that the 200 parts of behenyl acrylate (C22) were changed to 500 parts of stearyl acrylate (C18).

The crystalline resin C7 had a weight-average molecular weight of 38000, a melting point of 50° C., and an acid value of 3 mg KOH/g. The content ratio of the first monomer unit was 32.3 mass %.

Manufacturing Example of Crystalline Resin C8

A crystalline resin C8 was obtained as in the manufacturing example of the crystalline resin C3 except that the amount of behenyl acrylate (C22) was changed to 700 parts.

The crystalline resin C8 had a weight-average molecular weight of 28000, a melting point of 65° C., and an acid value of 30 mg KOH/g. The content ratio of the first monomer unit was 40.0 mass %.

Manufacturing Example of Amorphous Resin A1

Polyoxypropylene (2.2)-2,2-bis(4-hydroxyphenyl) propane: 73.4 parts (0.186 moles; 100.0 mol % relative to total moles of polyhydric alcohol)

Terephthalic acid: 11.6 parts (0.070 moles; 45.0 mol % relative to total moles of polyvalent carboxylic acids)

Adipic acid: 6.8 parts (0.047 moles; 30.0 mol % relative to total moles of polyvalent carboxylic acids)

Tin di(2-ethylhexylate): 0.5 parts

These materials were weighed into a reaction tank equipped with a cooling pipe, a stirrer, a nitrogen introduction pipe and a thermocouple. The interior of the flask was purged with nitrogen gas, the temperature was raised gradually under stirring, and the mixture was stirred at 200° C. while being reacted for 2 hours.

The pressure inside the reaction tank was then lowered to 8.3 kPa and maintained for 1 hour, after which the temperature was lowered to 180° C. and the pressure was returned to atmospheric pressure (first reaction step).

Trimellitic anhydride: 8.2 parts (0.039 moles; 25.0 mol % relative to total moles of polyvalent carboxylic acids)

Tert-butyl catechol (polymerization inhibitor): 0.1 part

The above materials were then added, the pressure inside the reaction tank was lowered to 8.3 kPa, and the temperature was maintained at 160° C. as the mixture was reacted for 15 hours. The temperature was lowered to stop the reaction (second reaction step) and obtain an amorphous resin A1. The resulting amorphous resin A1 had a peak molecular weight Mp of 11000, a glass transition temperature Tg of 58° C., and an acid value of 20 mg KOH/g.

Manufacturing Examples of Amorphous Resins A2 and A4 to A9

Amorphous resins A2 and A4 to A9 were obtained by performing the same reactions as in the manufacturing example of the amorphous resin A1 except that the alcohol component or carboxylic acid component and the molar ratios were changed as shown in Table 1-1. The mass parts of the raw materials were adjusted so that the total moles of the alcohol component and carboxylic acid component were the same as in the manufacturing example of the amorphous resin A1. The physical properties of the resulting amorphous resins are shown in Tables 1-1 and 1-2.

Manufacturing Example of Amorphous Resin A3

Polyoxypropylene (2.2)-2,2-bis(4-hydroxyphenyl) propane: 75.4 parts (0.192 moles; 100.0 mol % relative to total moles of alcohol component)

Terephthalic acid: 17.8 parts (0.111 moles; 70.0 mol % relative to total moles of carboxylic acid components)

Succinic acid: 3.4 parts (0.024 moles; 15.0 mol % relative to total moles of carboxylic acid components)

Oxalic acid: 3.4 parts (0.024 moles; 15.0 mol % relative to total moles of carboxylic acid components)

Tin di(2-ethylhexylate): 1.0 part per 100 parts of total monomer components

These materials were weighed into a reaction tank equipped with a cooling pipe, a stirrer, a nitrogen introduction pipe and a thermocouple. The interior of the flask was purged with nitrogen gas, the temperature was raised gradually under stirring, and the mixture was stirred at 200° C. while being reacted for 5 hours to obtain an amorphous resin A3.

The resulting amorphous resin A3 had a peak molecular weight of 4700 by GPC. The glass transition temperature was 56° C., and the acid value was 7 mg KOH/g.

Manufacturing Examples of Amorphous Resins A10 and A11

Amorphous resins A10 and A11 were obtained by performing the same reactions as in the manufacturing example of the amorphous resin A3 except that the alcohol component or carboxylic acid component and the molar ratios were changed as shown in Tables 1-1 and 1-2. The mass parts of the raw materials were adjusted so that the total moles of the alcohol component and carboxylic acid component were the same as in the manufacturing example of the amorphous resin A3. The physical properties are shown in Tables 1-1 and 1-2.

Manufacturing Example of Amorphous Resin A12

50 parts of a bisphenol A propylene oxide 2-mol adduct, 50 parts of a bisphenol A ethylene oxide 2-mol adduct, 10 parts of fumaric acid, 65 parts of terephthalic acid, 10 parts of acrylic acid and 15 parts of tin (II) dioctanoate were placed in a 4-necked flask equipped with a thermometer, a stirrer, and condenser and a nitrogen introduction pipe, and polymerized for 4.5 hours at 230° C. in a nitrogen atmosphere.

Once this had cooled to 160° C., 25 parts of trimellitic acid were added.

TABLE 1-1

| Amorphous resin | Alcohol | | | Acid | | | | | | | |
|---|---|---|---|---|---|---|---|---|---|---|---|
| polyester resin) No. | BPA-PO (2.2) | BPA-EO (2.2) | EG | TFA | TMA | FA C2 | OA C2 | SUA C4 | AA C6 | SEA C10 | DCA C16 |
| A1 | 100 mol % | | | 45 mol % | 25 mol % | | | | 30 mol % | | |
| A2 | 60 mol % | 40 mol % | | 45 mol % | 25 mol % | | | | 30 mol % | | |
| A3 | 100 mol % | | | 70 mol % | | | 15 mol % | 15 mol % | | | |
| A4 | 100 mol % | | | 30 mol % | 15 mol % | 25 mol % | | | 30 mol % | | |
| A5 | 100 mol % | | | 65 mol % | 25 mol % | | | | 10 mol % | | |
| A6 | 100 mol % | | | 6 mol % | 60 mol % | | | | 12 mol % | | 22 mol % |
| A7 | 100 mol % | | | 6 mol % | 60 mol % | | | | | | 34 mol % |
| A8 | 70 mol % | | 30 mol % | 45 mol % | 25 mol % | | | | 30 mol % | | |
| A9 | 100 mol % | | | 15 mol % | 25 mol % | | | | 60 mol % | | |
| A10 | 100 mol % | | | 85 mol % | | | | 15 mol % | | | |
| A11 | 100 mol % | | | 75 mol % | | | | 15 mol % | | 10 mol % | |

The abbreviations in the Table 1-1 are defined as follows.
BPA-PO (2.2): Bisphenol A propylene oxide 2.2-mol adduct
BPA-EO (2.2): Bisphenol A ethylene oxide 2.2-mol adduct
EG: ethylene glycol
TFA: Terephthalic acid
TMA: Trimellitic acid
FA: Fumaric acid
OA: Oxalic acid
SUA: Succinic acid
AA: Adipic acid
SEA: Sebacic acid
DCA: Dodecenylsuccinic acid anhydride Next, a mixture of 450 parts of styrene, 200 parts of 2-ethylhexyl acrylate and 30 parts of dicumyl peroxide as a polymerization initiator was dripped in over the course of 2 hours at 160° C. After completion of dripping, the temperature was raised to 200° C. and the mixture was reacted for 3 hours to obtain an amorphous resin A12 with a softening point of 115° C.

The resulting amorphous resin A12 had a peak molecular weight of 9000 by GPC. The glass transition temperature was 60° C., and the acid value was 5 mg KOH/g.

Manufacturing Example of Amorphous Resin A13

Low-molecular-weight polypropylene (Sanyo Chemical Industries, Ltd., Viscol 660P): 10.0 parts (0.02 moles; 2.4 mol % relative to total moles of constituent monomers)

Xylene: 25.0 parts

These materials were weighed into a reaction tank equipped with a cooling pipe, a stirrer, a nitrogen introduction pipe and a thermocouple. The flask was purged with nitrogen gas, and the temperature was gradually raised to 175° C. under stirring.

Styrene: 68.0 parts (0.65 moles; 76.4 mol % relative to total moles of constituent monomers)

Cyclohexyl methacrylate: 5.0 parts (0.03 moles; 3.5 mol % relative to total moles of constituent monomers)

Butyl acrylate: 12.0 parts (0.09 moles; 11.0 mol % relative to total moles of constituent monomers)

Methacrylic acid: 5.0 parts (0.06 moles; 6.7 mol % relative to total moles of constituent monomers)

Xylene: 10.0 parts

Di-t-butyl peroxyhexahydro terephthalate: 0.5 parts

These materials were then dripped in over the course of 2.5 hours, and the mixture was stirred for a further 40 minutes. The solvent was then distilled off to obtain an amorphous resin A13 comprising a styrene acrylic polymer grafted to a polyolefin.

The resulting amorphous resin A13 had a peak molecular weight of 11000 by GPC. The glass transition temperature was 62° C., and the acid value was 0.4 mg KOH/g.

TABLE 1-2

| Amorphous resin (polyester resin) No. | Physical properties | | | |
|---|---|---|---|---|
| | Mp | Tg | Acid value | Dielectric constant |
| A1 | 11000 | 58 | 20 | 2.5 |
| A2 | 10000 | 60 | 24 | 2.5 |
| A3 | 4700 | 56 | 7 | 2.5 |
| A4 | 11000 | 58 | 20 | 2.5 |
| A5 | 9000 | 62 | 15 | 2.5 |
| A6 | 20000 | 62 | 22 | 2.5 |
| A7 | 20000 | 62 | 20 | 2.5 |
| A8 | 9000 | 57 | 36 | 2.5 |
| A9 | 15000 | 54 | 45 | 2.5 |
| A10 | 4600 | 55 | 7 | 2.5 |
| A11 | 6200 | 54 | 5 | 2.5 |

The Tg is given in units of ° C. and the acid value in units of mg KOH/g, and the dielectric constant is the dielectric constant pF/m at 2 kHz.

Manufacturing Example of Binder Resin 1

32 parts of the amorphous resin A6 were mixed with 68 parts of the crystalline resin C1, and supplied at a rate of 52 kg/hour to a twin-screw kneader (Kurimoto, Ltd., S5KRC kneader) while at the same time 1.0 part of t-butyl peroxyisopropyl monocarbonate as a radical reaction initiator (c) was supplied at a rate of 0.52 kg/hour and the two were kneaded and extruded for 7 minutes at 160° C., 90 rpm to perform a crosslinking reaction, and then mixed as the pressure was lowered to 10 kPa from the vent mouth to remove the organic solvent. The mixed product was cooled to obtain a binder resin 1.

Manufacturing Examples of Binder Resins 2 to 14

Binder resins 2 to 14 were obtained as in the manufacturing example of the binder resin 1 except that the types and mixing ratios of the amorphous resin and crystalline resin were changed as shown in Table 2.

TABLE 2

| | Binder resin ① Crystalline resin | Parts | Binder resin ② Amorphous resin | Parts |
|---|---|---|---|---|
| Binder resin 1 | C1 | 68 | A6 | 32 |
| Binder resin 2 | C2 | 68 | A6 | 32 |
| Binder resin 3 | C2 | 68 | A8 | 32 |
| Binder resin 4 | C2 | 68 | A11 | 32 |
| Binder resin 5 | C2 | 68 | A9 | 32 |
| Binder resin 6 | C2 | 68 | A12 | 32 |
| Binder resin 7 | C2 | 25 | A6 | 75 |
| Binder resin 8 | C3 | 68 | A6 | 32 |
| Binder resin 9 | C4 | 68 | A6 | 32 |
| Binder resin 10 | C2 | 10 | A6 | 90 |
| Binder resin 11 | C5 | 68 | A6 | 32 |
| Binder resin 12 | C6 | 68 | A6 | 32 |
| Binder resin 13 | C7 | 68 | A6 | 32 |
| Binder resin 14 | C8 | 68 | A6 | 32 |

Manufacturing Example of Binder Resin 1 Fine Particle Dispersion

| | |
|---|---|
| Toluene: (Wako Pure Chemical) | 300 parts |
| Binder resin 1: | 100 parts |

These materials were weighed, mixed and dissolved at 90° C.

5.0 parts of sodium dodecylbenzenesulfonate and 10.0 parts of sodium laurate were separately added to 700 parts of ion-exchange water, and heated to dissolve at 90° C.

The toluene solution and the aqueous solution were then mixed and stirred at 7000 rpm with a T.K. Robomix ultra-high-speed stirring unit (Primix Corp.). This was then emulsified under 200 MPa of pressure with a high-pressure impact disperser nanomizer (Yoshida Kikai Co., Ltd.). The toluene was then removed with an evaporator, and the concentration was adjusted with ion-exchange water to obtain a 20 mass % aqueous dispersion of the binder resin 1 fine particle (binder resin 1 fine particle dispersion).

The 50% particle diameter (D50) of the binder resin 1 fine particle based on volume distribution was measured with a Nanotrac UPA-EXJ50 (Nikkiso Co., Ltd.) and found to be 0.40 μm.

Manufacturing Examples of Fine Particle Dispersions of Binder Resins 2 to 14

Fine particle dispersions of the binder resins 2 to 14 were obtained by emulsification as in the manufacturing example of the binder resin 1 fine particle dispersion except that the binder resins 2 to 14 were substituted for the binder resin 1.

Manufacturing Example of Amorphous Resin A1 Fine Particle Dispersion

| | |
|---|---|
| Tetrahydrofuran: (Wako Pure Chemical) | 300 parts |
| Amorphous resin A1: | 100 parts |
| Anionic surfactant Neogen RK (DKS Co. Ltd.): | 0.5 parts |

These materials were weighed, mixed and dissolved.

Next, 20.0 parts of 1 mol/liter ammonia water were added and stirred at 4000 rpm with an ultrahigh-speed T.K. Robomix agitator (Primix Corp.). 700 parts of ion-exchange water were then added at a rate of 8 g/min to precipitate an amorphous resin A1 fine particle. The tetrahydrofuran was then removed with an evaporator, and the concentration was adjusted with ion-exchange water to obtain an aqueous dispersion of the amorphous resin A1 fine particle with a concentration of 20 mass % (amorphous resin A1 fine particle dispersion).

The amorphous resin A1 fine particle dispersion had a volume-based 50% particle diameter (D50) of 0.13 μm.

Manufacturing Examples of Fine Particle Dispersions of Amorphous Resins A2 to A13

Fine particle dispersions of the amorphous resins A2 to A13 were obtained as in the manufacturing example of the amorphous resin A1 fine particle dispersion except that the amorphous resins A2 to A13 were substituted for the amorphous resin A1 in the amorphous resin A1 fine particle dispersion.

Manufacturing Examples of Fine Particle Dispersions of Crystalline Resins C1 to C8

Fine particle dispersions of the crystalline resins C1 to C8 were obtained as in the manufacturing example of the binder resin 1 dispersion except that the type of resin was changed to the crystalline resins C1 to C8.

Manufacturing Example of Release Agent (Aliphatic Hydrocarbon Compound) Fine Particle Dispersion

| | |
|---|---|
| Aliphatic hydrocarbon compound HNP-51 (Nippon Seiro) | 100 parts |
| Anionic surfactant Neogen RK (Daiichi Kogyo) | 5 parts |
| Ion-exchanged water | 395 parts |

These materials were weighed precisely, placed in a mixing vessel with an attached stirrer, heated to 90° C., and then dispersed for 60 minutes by recirculating into a Clearmix W-Motion (M Technique). The dispersion conditions were as follows.

| | |
|---|---|
| Outer rotor diameter | 3 cm |
| Clearance | 0.3 mm |
| Rotor speed | 19000 r/min |
| Screen rotation | 19000 r/min |

After being dispersed, this was cooled to 40° C. under conditions of rotor speed 1000 r/min, screen rotation 0 r/min, cooling speed 10° C./min to obtain a water-based dispersion (release agent (aliphatic hydrocarbon compound) fine particle dispersion) having a concentration of 20 mass % of the release agent (aliphatic hydrocarbon compound) fine particle.

The 50% volume-based particle diameter (D50) of the release agent (aliphatic hydrocarbon compound) fine particle was 0.15 μm as measured with a Nanotrac UPA-EX150 dynamic light scattering particle size distribution meter (Nikkiso).

Manufacture of Colorant Fine Particle Dispersion

| | |
|---|---|
| Colorant (Cyan pigment, Dainichi Seika Pigment Blue 15:3) | 50.0 parts |
| Neogen RK anionic surfactant (Daiichi Kogyo Seiyaku) | 7.5 parts |
| Ion-exchanged water | 442.5 parts |

These materials were weighed precisely, mixed, dissolved, and dispersed for about 1 hour with a with a Nanomizer high-pressure impact disperser (Yoshida Kikai) to disperse the colorant and obtained a water-based dispersion (colorant fine particle dispersion) having a concentration of 10 mass % of the colorant fine particle.

The 50% volume-based particle diameter (D50) of the colorant fine particle was 0.20 μm as measured with a Nanotrac UPA-EX150 dynamic light scattering particle size distribution meter (Nikkiso).

Toner Manufacturing Examples

Toner Particle 1 Manufacturing Example

Binder resin 1 fine particle dispersion: 500 parts

Release agent (aliphatic hydrocarbon compound fine particle dispersion): 50 parts Colorant fine particle dispersion: 80 parts Ion-exchange water: 160 parts These materials were placed in a round stainless steel flask and mixed, after which 10 parts of a 10% magnesium sulfate aqueous solution were added. This was then dispersed for 10 minutes at a rate of 5000 rpm with an Ultra-Turrax T50 homogenizer (IKA). This was then heated to 58° C. in a heating water bath while appropriately adjusting the rotation with a stirring blade so as to stir the mixture.

The volume-average particle diameter of the formed aggregate particles was confirmed appropriately with a Coulter Multisizer III, and once aggregate particles with a volume-average particle diameter of about 6.00 μm had formed, 100 parts of a 5% aqueous solution of ethylenediamine tetrasodium acetate were added, and the mixture was heated to 75° C. under continued stirring. This was then maintained for 1 hour at 75° C. to fuse the aggregate particles.

This was then cooled to 50° C. and maintained for 3 hours to promote polymer crystallization.

As a step to remove multivalent metal ions derived from the flocculant, this was then maintained at 50° C. while being washed with a 5% aqueous solution of ethylenediamine tetrasodium acetate.

This was then cooled to 25° C., subjected to filtration and solid-liquid separation, and then washed with ion-exchange water. After completion of washing it was dried with a vacuum drier to obtain a toner particle 1 with a weight-average particle diameter (D4) of about 6.07 μm.

Manufacturing Examples of Toner Particles 2, 4 to 45 and 51 to 60

Toner particles 2, 4 to 45 and 51 to 60 were obtained by the same operations as in the toner particle 1 manufacturing example except that the type and added amount of the binder resin 1 fine particle dispersion, the type and added amount of the crystalline fine particle, the type and added amount of the amorphous resin fine particle, the type and added amount of the flocculant, the type of the removal agent and the addition temperature of the removal agent were changed as shown in Table 3.

Toner Particle 3 Manufacturing Example

| | |
|---|---|
| Binder resin 2: | 100.0 parts |
| Aliphatic hydrocarbon compound HNP-51 (Nippon Seiro Co., Ltd.): | 10 parts |
| C.I. pigment blue 15:3: | 6.5 parts |
| 3,5-di-t-butyl aluminum salicylate compound: | 0.02 parts |

These materials were mixed at a rotation speed of 20 $s^{-1}$ for a rotation time of 5 minutes with a Henschel mixer (FM-75. Nippon Coke & Engineering Co., Ltd.), and then kneaded at a discharge temperature of 135° C. in a twin-screw kneader (PCM-30, Ikegai) set to a screw rotation of 200 rpm at a temperature of 120° C. The kneaded product was cooled at a cooling rate of 15° C./min and coarsely crushed to not more than 1 mm in a hammer mill to obtain a crushed product. The crushed product was then pulverized with a mechanical pulverizer (T-250, Freund-Turbo Corporation).

This was then classified with a Faculty F-300 (Hosokawa Micron Corporation) to obtain a toner particle 3. For the operating conditions, the classifying rotor speed was set to 130 $s^{-1}$ and the dispersion rotor speed to 120 $s^{-1}$.

Toner Particle 46 Manufacturing Example

A toner particle 46 was obtained as in the toner particle 3 manufacturing example except that the type and amount of the binder resin were changed as shown in table 3.

Toner Particle 47 Manufacturing Example

A toner particle 47 was obtained as in the toner particle 3 manufacturing example except that the type and amount of the binder resin were changed as shown in Table 3, and the screw rotation speed of the twin-screw mixer was changed to 300 rpm.

Toner Particle 48 Manufacturing Example

A toner particle 48 was obtained as in the toner particle 3 manufacturing example except that the type and amount of the binder resin were changed as shown in Table 3, and the screw rotation speed of the twin-screw mixer was changed to 150 rpm.

Toner Particle 49 Manufacturing Example

A toner particle 49 was obtained as in the toner particle 3 manufacturing example except that the type and amount of the binder resin were changed as shown in Table 3, the temperature of the twin screw mixer was changed to 100° C., and the screw rotation speed was changed to 350 rpm.

Toner Particle 50 Manufacturing Example

A toner particle 50 was obtained as in the toner particle 3 manufacturing example except that the type and amount of the binder resin were changed as shown in Table 3, the temperature of the twin screw mixer was changed to 140° C., and the screw rotation speed was changed to 100 rpm.

Toner 1 Manufacturing Example

| | |
|---|---|
| Toner particle 1: | 100 parts |
| Large particle size silica fine particle (average particle diameter 130 nm) surface treated with hexamethyl disilazane: | 3 parts |
| Small particle size silica fine particle (average particle diameter 20 nm) surface treated with hexamethyl disilazane: | 1 part |

These materials were mixed for 10 minutes at a rotation speed of 30 $s^{-1}$ for a rotation time of 10 min with an FM-10C Henschel mixer (Mitsui Miike Machinery Co., Ltd.) to obtain a toner 1.

The toner 1 had a weight-average particle diameter (D4) of 6.1 μm and an average circularity of 0.975. The physical properties of the toner 1 are shown in Table 4.

Manufacturing Examples of Toners 2 to 60

Toners 2 to 60 were obtained as in the toner 1 manufacturing example except that the type of toner particle was changed as shown in Table 3. The physical properties are shown in Table 4. In toners 22 to 25, the removal step was adjusted so that that ratio of the monovalent metal element was as shown in Table 4.

In cross-sectional observation of the resulting toners, a domain-matrix structured composed of a matrix containing a first resin (crystalline resin) and domains containing a second resin (amorphous resin) was observed in the toners 1 to 50, 52 to 56 and 58 to 60.

In the toners 51 and 57, a domain-matrix structure composed of a matrix containing the second resin and domains containing the first resin was observed.

TABLE 3

| Toner No. | Toner particle No. | M | Formulation: Resin fine particle dispersion ① Type | Parts | Resin fine particle dispersion ② Type | Parts | Flocculant Type | Parts | Removal agent Type | Temp. [° C.] |
|---|---|---|---|---|---|---|---|---|---|---|
| 1 | 1 | EA | Binder resin 1 | 500 | — | — | Mg | 0.0200 | Na | 50 |
| 2 | 2 | EA | Binder resin 2 | 500 | — | — | Mg | 0.0200 | Na | 70 |
| 3 | 3 | MK | | | Described separately | | | | | |
| 4 | 4 | EA | Binder resin 2 | 500 | — | — | Al | 0.0200 | Na | 70 |
| 5 | 5 | EA | Binder resin 2 | 500 | — | — | Ca | 0.0200 | Na | 70 |
| 6 | 6 | EA | Binder resin 2 | 500 | — | — | Fe | 0.0200 | Na | 70 |
| 7 | 7 | EA | Binder resin 2 | 590 | — | — | Zn | 0.0200 | Na | 70 |
| 8 | 8 | EA | Binder resin 12 | 500 | — | — | Al | 0.0200 | Na | 40 |
| 9 | 9 | EA | Binder resin 13 | 500 | — | — | Al | 0.0200 | Na | 80 |
| 10 | 10 | EA | Binder resin 14 | 500 | — | — | Al | 0.0200 | Na | 30 |
| 11 | 11 | EA | Binder resin 4 | 500 | — | — | Al | 0.0200 | Na | 30 |
| 12 | 12 | EA | Binder resin 3 | 500 | — | — | Al | 0.0200 | Na | 30 |
| 13 | 13 | EA | Binder resin 12 | 500 | — | — | Al | 1.0000 | Na | 30 |
| 14 | 14 | EA | Binder resin 12 | 500 | — | — | Al | 0.0030 | Na | 30 |
| 15 | 15 | EA | Crystalline resin C2 | 350 | Amorphous resin A6 | 150 | Al | 0.0200 | Na | 30 |
| 16 | 16 | EA | Binder resin 6 | 500 | — | — | Al | 0.0200 | Na | 30 |
| 17 | 17 | EA | Crystalline resin C2 | 350 | Amorphous resin A12 | 150 | Al | 0.0200 | Na | 30 |
| 18 | 18 | EA | Crystalline resin C2 | 350 | Amorphous resin A6 | 150 | Al | 1.5000 | Na | 30 |
| 19 | 19 | EA | Crystalline resin C2 | 350 | Amorphous resin A6 | 150 | Al | 2.0000 | Na | 30 |
| 20 | 20 | EA | Crystalline resin C2 | 350 | Amorphous resin A6 | 150 | Al | 0.0200 | Na | 30 |
| 21 | 21 | EA | Crystalline resin C2 | 350 | Amorphous resin A6 | 150 | Al | 2.5000 | Na | 30 |
| 22 | 22 | EA | Crystalline resin C2 | 350 | Amorphous resin A6 | 150 | Al | 0.0200 | Na | 30 |
| 23 | 23 | EA | Crystalline resin C2 | 350 | Amorphous resin A6 | 150 | Al | 0.0200 | Na | 30 |
| 24 | 24 | EA | Crystalline resin C2 | 350 | Amorphous resin A6 | 150 | Al | 0.0200 | Na | 30 |
| 25 | 25 | EA | Crystalline resin C2 | 350 | Amorphous resin A6 | 150 | Al | 0.0200 | Na | 30 |
| 26 | 26 | EA | Crystalline resin C2 | 350 | Amorphous resin A6 | 150 | Al | 0.0200 | Li | 30 |
| 27 | 27 | EA | Crystalline resin C2 | 350 | Amorphous resin A6 | 150 | Al | 0.0200 | K | 30 |
| 28 | 28 | EA | Crystalline resin C2 | 350 | Amorphous resin A6 | 150 | Al | 0.0200 | None | — |
| 29 | 29 | EA | Crystalline resin C2 | 250 | Amorphous resin A6 | 250 | Al | 0.0200 | Na | 30 |
| 30 | 30 | EA | Crystalline resin C2 | 200 | Amorphous resin A6 | 300 | Al | 0.0200 | Na | 30 |
| 31 | 31 | EA | Crystalline resin C2 | 250 | Amorphous resin A3 | 250 | Al | 0.0200 | Na | 30 |
| 32 | 32 | EA | Crystalline resin C2 | 250 | Amorphous resin A7 | 250 | Al | 0.0200 | Na | 30 |
| 33 | 33 | EA | Crystalline resin C2 | 150 | Amorphous resin A7 | 350 | Al | 0.0200 | Na | 30 |
| 34 | 34 | EA | Crystalline resin C2 | 475 | Amorphous resin A3 | 25 | Al | 0.0200 | Na | 30 |
| 35 | 35 | EA | Crystalline resin C2 | 350 | Amorphous resin A1 | 150 | Al | 0.0200 | Na | 30 |
| 36 | 36 | EA | Crystalline resin C2 | 350 | Amorphous resin A2 | 150 | Al | 0.0200 | Na | 30 |
| 37 | 37 | EA | Crystalline resin C2 | 350 | Amorphous resin A3 | 150 | Al | 0.0200 | Na | 30 |
| 38 | 38 | EA | Crystalline resin C2 | 350 | Amorphous resin A4 | 150 | Al | 0.0200 | Na | 30 |
| 39 | 39 | EA | Crystalline resin C2 | 350 | Amorphous resin A5 | 150 | Al | 0.0200 | Na | 30 |
| 40 | 40 | EA | Crystalline resin C2 | 350 | Amorphous resin A10 | 150 | Al | 0.0200 | Na | 30 |
| 41 | 41 | EA | Crystalline resin C2 | 350 | Amorphous resin A11 | 150 | Al | 0.0200 | Na | 30 |
| 42 | 42 | EA | Crystalline resin C2 | 350 | Amorphous resin A7 | 150 | Al | 0.0200 | Na | 30 |
| 43 | 43 | EA | Crystalline resin C2 | 350 | Amorphous resin A3 | 150 | Al | 0.0025 | Na | 30 |
| 44 | 44 | EA | Crystalline resin C2 | 350 | Amorphous resin A3 | 150 | Al | 0.0500 | Na | 30 |
| 45 | 45 | EA | Crystalline resin C2 | 250 | Amorphous resin AS | 250 | Al | 0.0520 | Na | 30 |
| 46 | 46 | MK | Crystalline resin C2 | 250 | Amorphous resin A3 | 250 | Al | 0.0520 | Na | 30 |
| 47 | 47 | MK | Crystalline resin C2 | 200 | Amorphous resin A3 | 300 | Al | 0.0520 | Na | 30 |
| 48 | 48 | MK | Crystalline resin C2 | 200 | Amorphous resin A3 | 300 | Al | 0.0520 | Na | 30 |
| 49 | 49 | MK | Crystalline resin C2 | 150 | Amorphous resin A3 | 350 | Al | 0.0520 | Na | 30 |
| 50 | 50 | MK | Crystalline resin C2 | 150 | Amorphous resin A3 | 350 | Al | 0.0520 | Na | 30 |
| 51 | 51 | EA | Binder resin 7 | 500 | — | — | Mg | 0.0200 | Na | 30 |
| 52 | 52 | EA | Binder resin 8 | 500 | — | — | Mg | 0.0200 | Na | 30 |
| 53 | 53 | EA | Binder resin 9 | 500 | — | — | Mg | 0.0200 | Na | 30 |
| 54 | 54 | EA | Binder resin 11 | 500 | — | — | Mg | 0.0200 | Na | 30 |
| 55 | 55 | EA | Crystalline resin C2 | 350 | Amorphous resin A13 | 150 | Mg | 0.0200 | Na | 30 |
| 56 | 56 | EA | Binder resin 5 | 500 | — | — | Mg | 0.0200 | Na | 30 |
| 57 | 57 | EA | Binder resin 10 | 500 | — | — | Mg | 0.0200 | Na | 30 |
| 58 | 58 | EA | Binder resin 2 | 500 | — | — | None | — | Na | 30 |

TABLE 3-continued

| | | | Formulation | | | | | | | |
|---|---|---|---|---|---|---|---|---|---|---|
| | Toner | | | | | | | | Removal agent | |
| Toner | particle | | Resin fine particle dispersion ① | | Resin fine particle dispersion ② | | Flocculant | | | Temp. |
| No. | No. | M | Type | Parts | Type | Parts | Type | Parts | Type | [° C.] |
| 59 | 59 | EA | Binder resin 2 | 500 | — | — | Mg | 0.0010 | Na | 30 |
| 60 | 60 | EA | Binder resin 2 | 500 | — | — | Mg | 3.1000 | Na | 90 |

The abbreviations in Table 3 are defined as follows:
M: Manufacturing method
EA: Emulsion aggregation
SP: Suspension polymerization
MK: Melt kneading
Mg: Magnesium sulfate
Ca: Calcium nitrate
Zn: Zinc chloride
Al: Aluminum sulfate
Fe: Ferric polysulfate
Na: Ethylenediamine tetrasodium acetate
Li: Lithium citrate
K: Potassium citrate
Temp.: Temperature

TABLE 4

| | | | | | | Physical properties | | | | | | | | | |
|---|---|---|---|---|---|---|---|---|---|---|---|---|---|---|---|
| Toner No. | Toner particle No. | X | X/Y | Mw(A) | Mw(A)/Mn(A) | Mul | Mon | MR | D4 μm | DM65 $\times 10^7$ [Pa] | DM85 $\times 10^6$ [Pa] | DD μm | U1 mass % | M/U | AC |
| 1 | 1 | 60 | 2.3 | 36000 | 7.4 | 0.0200 | 0.030 | 60 | 6.1 | 4.10 | 0.90 | 1.0 | 67.0 | 3.0 | 0.975 |
| 2 | 2 | 60 | 2.3 | 36000 | 7.4 | 0.0200 | 0.030 | 60 | 6.1 | 4.10 | 0.90 | 1.0 | 49.0 | 4.1 | 0.975 |
| 3 | 3 | 80 | 2.3 | 36000 | 7.4 | 0.0200 | 0.030 | 60 | 6.1 | 4.10 | 0.90 | 1.0 | 49.0 | 4.1 | 0.960 |
| 4 | 4 | 60 | 2.3 | 36000 | 7.4 | 0.0200 | 0.030 | 60 | 6.1 | 4.10 | 0.90 | 1.0 | 49.0 | 4.1 | 0.975 |
| 5 | 5 | 60 | 2.3 | 36000 | 7.4 | 0.0200 | 0.030 | 60 | 6.1 | 4.10 | 0.90 | 1.0 | 49.0 | 4.1 | 0.975 |
| 6 | 6 | 60 | 2.3 | 36000 | 7.4 | 0.0200 | 0.030 | 60 | 6.1 | 4.10 | 0.90 | 1.0 | 49.0 | 4.1 | 0.975 |
| 7 | 7 | 60 | 2.3 | 36000 | 7.4 | 0.0200 | 0.030 | 60 | 6.1 | 4.10 | 0.90 | 1.0 | 49.0 | 4.1 | 0.975 |
| 8 | 8 | 60 | 2.3 | 36000 | 7.4 | 0.0200 | 0.030 | 60 | 6.1 | 4.10 | 0.90 | 1.0 | 35.0 | 5.7 | 0.975 |
| 9 | 9 | 60 | 2.3 | 36000 | 7.4 | 0.0200 | 0.030 | 60 | 6.1 | 4.10 | 0.90 | 1.0 | 80.0 | 2.5 | 0.975 |
| 10 | 10 | 60 | 2.3 | 36000 | 7.4 | 0.0200 | 0.030 | 60 | 6.1 | 4.10 | 0.90 | 1.0 | 80.0 | 2.5 | 0.975 |
| 11 | 11 | 60 | 2.3 | 36000 | 7.4 | 0.0200 | 0.030 | 60 | 6.1 | 4.10 | 0.90 | 1.0 | 49.0 | 4.1 | 0.975 |
| 12 | 12 | 60 | 2.3 | 36000 | 7.4 | 0.0200 | 0.030 | 60 | 6.1 | 4.10 | 0.90 | 1.0 | 49.0 | 4.1 | 0.975 |
| 13 | 13 | 60 | 2.3 | 36000 | 7.4 | 1.0000 | 0.053 | 5 | 6.1 | 5.00 | 1.00 | 1.0 | 35.0 | 285.7 | 0.975 |
| 14 | 14 | 60 | 2.3 | 36000 | 7.4 | 0.0030 | 0.027 | 90 | 6.1 | 3.00 | 0.90 | 1.0 | 35.0 | 0.9 | 0.975 |
| 15 | 15 | 70 | 2.3 | 36000 | 7.4 | 0.0200 | 0.030 | 60 | 6.1 | 1.50 | 0.95 | 1.0 | 49.0 | 4.1 | 0.975 |
| 16 | 16 | 60 | 2.3 | 36000 | 7.4 | 0.0200 | 0.030 | 60 | 6.1 | 3.00 | 0.97 | 1.0 | 49.0 | 4.1 | 0.975 |
| 17 | 17 | 70 | 2.3 | 36000 | 7.4 | 0.0200 | 0.030 | 60 | 6.1 | 3.00 | 0.90 | 1.0 | 49.0 | 4.1 | 0.975 |
| 18 | 18 | 70 | 2.3 | 36000 | 7.4 | 1.5000 | 0.046 | 3 | 6.1 | 3.00 | 0.97 | 1.0 | 49.0 | 306.1 | 0.975 |
| 19 | 19 | 70 | 2.3 | 36000 | 7.4 | 2.0000 | 0.041 | 2 | 6.1 | 3.00 | 1.50 | 1.0 | 49.0 | 408.2 | 0.975 |
| 20 | 20 | 70 | 2.3 | 36000 | 7.4 | 0.0200 | 0.030 | 60 | 6.1 | 1.00 | 0.90 | 1.0 | 49.0 | 4.1 | 0.975 |
| 21 | 21 | 70 | 2.3 | 36000 | 7.4 | 2.5000 | 0.025 | 1 | 6.1 | 5.10 | 1.50 | 1.0 | 49.0 | 510.2 | 0.975 |
| 22 | 22 | 70 | 2.3 | 36000 | 7.4 | 0.0200 | 0.020 | 50 | 6.1 | 3.00 | 0.90 | 1.0 | 49.0 | 4.1 | 0.975 |
| 23 | 23 | 70 | 2.3 | 36000 | 7.4 | 0.0200 | 0.180 | 90 | 6.1 | 3.00 | 0.90 | 1.0 | 49.0 | 4.1 | 0.975 |
| 24 | 24 | 70 | 2.3 | 36000 | 7.4 | 0.0200 | 0.380 | 95 | 6.1 | 3.00 | 0.90 | 1.0 | 49.0 | 4.1 | 0.975 |
| 25 | 25 | 70 | 2.3 | 36000 | 7.4 | 0.0200 | 0.009 | 30 | 6.1 | 3.00 | 0.90 | 1.0 | 49.0 | 4.1 | 0.975 |
| 28 | 28 | 70 | 2.3 | 36000 | 7.4 | 0.0200 | 0.030 | 60 | 6.1 | 3.00 | 0.90 | 1.0 | 49.0 | 4.1 | 0.975 |
| 27 | 27 | 70 | 2.3 | 36000 | 7.4 | 0.0200 | 0.030 | 60 | 6.1 | 3.00 | 0.90 | 1.0 | 49.0 | 4.1 | 0.975 |
| 26 | 26 | 70 | 2.3 | 36000 | 7.4 | 0.0200 | 0.000 | 0 | 6.1 | 3.00 | 0.90 | 1.0 | 49.0 | 4.1 | 0.975 |
| 29 | 29 | 50 | 1.0 | 36000 | 7.4 | 0.0200 | 0.030 | 60 | 6.1 | 3.00 | 0.90 | 1.0 | 49.0 | 4.1 | 0.975 |
| 30 | 30 | 40 | 0.7 | 36000 | 7.4 | 0.0200 | 0.030 | 60 | 6.1 | 3.00 | 0.90 | 1.0 | 49.0 | 4.1 | 0.975 |
| 31 | 31 | 50 | 1.0 | 26000 | 7.8 | 0.0200 | 0.030 | 60 | 6.1 | 3.00 | 0.90 | 1.0 | 49.0 | 4.1 | 0.975 |
| 32 | 32 | 50 | 1.0 | 56000 | 6.2 | 0.0200 | 0.030 | 60 | 6.1 | 3.00 | 0.90 | 1.0 | 49.0 | 4.1 | 0.975 |
| 33 | 33 | 30 | 0.4 | 62000 | 5.0 | 0.0200 | 0.030 | 60 | 6.1 | 3.00 | 0.90 | 1.0 | 49.0 | 4.1 | 0.975 |
| 34 | 34 | 95 | 19.0 | 24000 | 8.4 | 0.0200 | 0.030 | 60 | 6.1 | 3.00 | 0.90 | 1.0 | 49.0 | 4.1 | 0.975 |
| 35 | 35 | 70 | 2.3 | 36000 | 7.4 | 0.0200 | 0.030 | 60 | 6.1 | 3.00 | 0.90 | 1.0 | 49.0 | 4.1 | 0.975 |
| 36 | 36 | 70 | 2.3 | 36000 | 7.4 | 0.0200 | 0.030 | 60 | 6.1 | 3.00 | 0.90 | 1.0 | 49.0 | 4.1 | 0.975 |
| 37 | 37 | 70 | 2.3 | 36000 | 7.4 | 0.0200 | 0.030 | 60 | 6.1 | 3.00 | 0.90 | 1.0 | 49.0 | 4.1 | 0.975 |
| 38 | 38 | 70 | 2.3 | 36000 | 7.4 | 0.0200 | 0.030 | 60 | 6.1 | 3.00 | 0.90 | 1.0 | 49.0 | 4.1 | 0.975 |
| 39 | 39 | 70 | 2.3 | 36000 | 7.4 | 0.0200 | 0.030 | 60 | 6.1 | 3.00 | 0.90 | 1.0 | 49.0 | 4.1 | 0.975 |
| 40 | 40 | 70 | 2.3 | 26000 | 7.8 | 0.0200 | 0.030 | 60 | 6.1 | 3.00 | 0.90 | 1.0 | 49.0 | 4.1 | 0.975 |
| 41 | 41 | 70 | 2.3 | 36000 | 7.4 | 0.0200 | 0.030 | 60 | 6.1 | 3.00 | 0.90 | 1.0 | 49.0 | 4.1 | 0.975 |
| 42 | 42 | 70 | 2.3 | 36000 | 7.4 | 0.0200 | 0.030 | 60 | 6.1 | 3.00 | 0.90 | 1.0 | 49.0 | 4.1 | 0.975 |
| 43 | 43 | 70 | 2.3 | 26000 | 7.8 | 0.0025 | 0.023 | 90 | 6.1 | 3.00 | 0.90 | 1.0 | 49.0 | 0.5 | 0.975 |
| 44 | 44 | 70 | 2.3 | 26000 | 7.8 | 0.0500 | 0.021 | 30 | 6.1 | 3.00 | 0.90 | 1.0 | 49.0 | 10.2 | 0.975 |

TABLE 4-continued

| Toner No. | Toner particle No. | X | X/Y | Mw(A) | Mw(A)/Mn(A) | Physical properties | | | | | | | | | |
|---|---|---|---|---|---|---|---|---|---|---|---|---|---|---|---|
| | | | | | | Mul | Mon | MR | D4 μm | DM65 $\times 10^7$ [Pa] | DM85 $\times 10^6$ [Pa] | DD μm | U1 mass % | M/U | AC |
| 45 | 45 | 50 | 1.0 | 26000 | 7.8 | 0.0520 | 0.022 | 30 | 6.1 | 3.00 | 0.90 | 1.0 | 49.0 | 10.6 | 0.975 |
| 46 | 46 | 50 | 1.0 | 26000 | 7.8 | 0.0520 | 0.022 | 30 | 6.1 | 3.00 | 0.90 | 1.0 | 49.0 | 10.6 | 0.960 |
| 47 | 47 | 40 | 0.7 | 26000 | 7.8 | 0.0520 | 0.022 | 30 | 6.1 | 3.00 | 0.90 | 0.4 | 49.0 | 10.6 | 0.960 |
| 48 | 48 | 40 | 0.7 | 26000 | 7.8 | 0.0520 | 0.022 | 30 | 6.1 | 3.00 | 0.90 | 1.9 | 49.0 | 10.6 | 0.960 |
| 49 | 49 | 30 | 0.4 | 26000 | 7.8 | 0.0520 | 0.022 | 30 | 6.1 | 3.00 | 0.90 | 0.1 | 49.0 | 10.6 | 0.960 |
| 50 | 50 | 30 | 0.4 | 26000 | 7.8 | 0.0520 | 0.022 | 30 | 6.1 | 3.00 | 0.90 | 3.0 | 49.0 | 10.6 | 0.960 |
| 51 | 51 | 23 | 0.3 | 36000 | 7.4 | 0.0200 | 0.030 | 60 | 6.1 | 3.00 | 0.90 | 1.0 | 49.0 | 4.1 | 0.975 |
| 52 | 52 | 60 | 2.3 | 36000 | 7.4 | 0.0200 | 0.030 | 60 | 6.1 | 3.00 | 0.90 | 1.0 | 23.5 | 8.5 | 0.975 |
| 53 | 53 | 60 | 2.3 | 36000 | 7.4 | 0.0200 | 0.030 | 60 | 6.1 | 3.00 | 0.90 | 1.0 | 0.0 | — | 0.975 |
| 54 | 54 | 60 | 2.3 | 36000 | 7.4 | 0.0200 | 0.030 | 60 | 6.1 | 3.00 | 0.90 | 1.0 | 60.0 | 3.3 | 0.975 |
| 55 | 55 | 70 | 2.3 | 36000 | 7.4 | 0.0200 | 0.030 | 60 | 6.1 | 3.00 | 0.90 | 1.0 | 49.0 | 4.1 | 0.975 |
| 56 | 56 | 60 | 2.3 | 36000 | 7.4 | 0.0200 | 0.030 | 60 | 6.1 | 3.00 | 0.90 | 1.0 | 49.0 | 4.1 | 0.975 |
| 57 | 57 | 9 | 0.1 | 36000 | 7.4 | 0.0200 | 0.030 | 60 | 6.1 | 3.00 | 0.90 | 1.0 | 49.0 | 4.1 | 0.975 |
| 58 | 58 | 60 | 2.3 | 36000 | 7.4 | 0.0000 | 0.000 | 30 | 6.1 | 3.00 | 0.90 | 1.0 | 49.0 | 0.0 | 0.975 |
| 59 | 59 | 60 | 2.3 | 36000 | 7.4 | 0.0010 | — | 100 | 6.1 | 3.00 | 0.90 | 1.0 | 49.0 | 0.2 | 0.975 |
| 60 | 60 | 60 | 2.3 | 36000 | 7.4 | 3.1000 | 0.031 | 1 | 6.1 | 3.00 | 0.90 | 1.0 | 49.0 | 632.7 | 0.975 |

In the table, X is the content (mass %) of the first resin in the binder resin, and X/Y is the mass ratio of the content X of the first resin to the content Y of the second resin in the binder resin. Mul represents Multivalent metal content [parts], Mon represents Monovalent metal content [parts] and MR represents Monovalent metal ratio [mass %], and the metal content [parts] is the amount per 100 parts of the binder resin. D4 is the weight-average particle diameter. DM65 represents the complex elastic modulus at 65° C., and DM85 represents the complex elastic modulus at 85° C. DD represents domain diameter, and the domain diameter is the number-average diameter of the domains.

U1 indicates the content ratio of the first monomer unit in the first resin. M/U represents (Mass parts of multivalent metal element per 100 mass parts of binder resin in toner)×10000/(content ratio of first monomer unit in first resin). AC is the average circularity.

Manufacturing Example of Magnetic Carrier 1

Magnetite 1 with number-average particle diameter of 0.30 μm (magnetization strength 65 $Am^2/kg$ in 1000/4π (kA/m) magnetic field)

Magnetite 2 with number-average particle diameter of 0.50 μm (magnetization strength 65 $Am^2/kg$ in 1000/4π (kA/m) magnetic field)

4.0 parts of a silane compound (3-(2-aminoethylamino-propyl)trimethoxysilane) were added to 100 parts each of the above materials, and mixed and stirred at high speed at 100° C. or more in a vessel to treat the respective fine particles.

Phenol: 10 mass %

Formaldehyde solution: 6 mass %
(formaldehyde 40 mass %, methanol 10 mass %, water 50 mass %)

Magnetite 1 treated with silane compound: 58 mass %

Magnetite 2 treated with silane compound: 26 mass %

100 parts of these materials, 5 parts of 28 mass % aqueous ammonia solution and 20 parts of water were placed in a flask, and stirred and mixed as the temperature was raised to 85° C. for 30 minutes, and maintained for 3 hours to perform a polymerization reaction, and the resulting phenol resin was hardened.

The hardened phenol resin was then cooled to 30° C., water was added, the supernatant was removed, and the precipitate was water washed and air dried. This was then dried at 60° C. under reduced pressure (5 mmHg or less) to obtain a magnetic dispersion-type spherical magnetic carrier. The volume-based 50% particle diameter (D50) was 34.2 μm.

Manufacturing Example of Two-Component Developer 1

92.0 parts of the magnetic carrier 1 and 8.0 parts of the toner 1 were mixed in a V-type mixer (V-20, Seishin Enterprise Co., Ltd.) to obtain a two-component developer 1.

Manufacturing Examples of Two-Component Developers 2 to 60

The two-component developers 2 to 60 were obtained as in the manufacturing example of the two-component developer 1 except that the toners were changed as shown in Table 5.

TABLE 5

| Toner No. | Carrier No. | Two-component developer No. |
|---|---|---|
| Toner 1 | Carrier 1 | Two-component developer 1 |
| Toner 2 | Carrier 1 | Two-component developer 2 |
| Toner 3 | Carrier 1 | Two-component developer 3 |
| Toner 4 | Carrier 1 | Two-component developer 4 |
| Toner 5 | Carrier 1 | Two-component developer 5 |
| Toner 6 | Carrier 1 | Two-component developer 6 |
| Toner 7 | Carrier 1 | Two-component developer 7 |
| Toner 8 | Carrier 1 | Two-component developer 8 |
| Toner 9 | Carrier 1 | Two-component developer 9 |
| Toner 10 | Carrier 1 | Two-component developer 10 |
| Toner 11 | Carrier 1 | Two-component developer 11 |
| Toner 12 | Carrier 1 | Two-component developer 12 |
| Toner 13 | Carrier 1 | Two-component developer 13 |
| Toner 14 | Carrier 1 | Two-component developer 14 |
| Toner 15 | Carrier 1 | Two-component developer 15 |
| Toner 16 | Carrier 1 | Two-component developer 16 |
| Toner 17 | Carrier 1 | Two-component developer 17 |
| Toner 18 | Carrier 1 | Two-component developer 18 |
| Toner 19 | Carrier 1 | Two-component developer 10 |
| Toner 20 | Carrier 1 | Two-component developer 20 |
| Toner 21 | Carrier 1 | Two-component developer 21 |
| Toner 22 | Carrier 1 | Two-component developer 22 |
| Toner 23 | Carrier 1 | Two-component developer 23 |
| Toner 24 | Carrier 1 | Two-component developer 24 |
| Toner 25 | Carrier 1 | Two-component developer 25 |
| Toner 26 | Carrier 1 | Two-component developer 26 |
| Toner 27 | Carrier 1 | Two-component developer 27 |
| Toner 28 | Carrier 1 | Two-component developer 28 |
| Toner 29 | Carrier 1 | Two-component developer 29 |
| Toner 30 | Carrier 1 | Two-component developer 30 |
| Toner 31 | Carrier 1 | Two-component developer 31 |
| Toner 32 | Carrier 1 | Two-component developer 32 |

TABLE 5-continued

| Toner No. | Carrier No. | Two-component developer No. |
|---|---|---|
| Toner 33 | Carrier 1 | Two-component developer 33 |
| Toner 34 | Carrier 1 | Two-component developer 34 |
| Toner 35 | Carrier 1 | Two-component developer 35 |
| Toner 36 | Carrier 1 | Two-component developer 36 |
| Toner 37 | Carrier 1 | Two-component developer 37 |
| Toner 38 | Carrier 1 | Two-component developer 38 |
| Toner 39 | Carrier 1 | Two-component developer 39 |
| Toner 40 | Carrier 1 | Two-component developer 40 |
| Toner 41 | Carrier 1 | Two-component developer 41 |
| Toner 42 | Carrier 1 | Two-component developer 42 |
| Toner 43 | Carrier 1 | Two-component developer 43 |
| Toner 44 | Carrier 1 | Two-component developer 44 |
| Toner 45 | Carrier 1 | Two-component developer 45 |
| Toner 46 | Carrier 1 | Two-component developer 46 |
| Toner 47 | Carrier 1 | Two-component developer 47 |
| Toner 48 | Carrier 1 | Two-component developer 48 |
| Toner 49 | Carrier 1 | Two-component developer 49 |
| Toner 50 | Carrier 1 | Two-component developer 50 |
| Toner 51 | Carrier 1 | Two-component developer 51 |
| Toner 52 | Carrier 1 | Two-component developer 52 |
| Toner 53 | Carrier 1 | Two-component developer 53 |
| Toner 54 | Carrier 1 | Two-component developer 54 |
| Toner 55 | Carrier 1 | Two-component developer 55 |
| Toner 56 | Carrier 1 | Two-component developer 56 |
| Toner 57 | Carrier 1 | Two-component developer 57 |
| Toner 58 | Carrier 1 | Two-component developer 58 |
| Toner 59 | Carrier 1 | Two-component developer 59 |
| Toner 60 | Carrier 1 | Two-component developer 60 |

Toner Evaluation Methods

Method for Evaluating Low-Temperature Fixability

Paper: GFC-081 (81.0 g/m$^2$)(sold by Canon Marketing Japan Inc.)

Toner laid-on level on paper: 0.50 mg/cm$^2$ (adjusted by means of DC voltage VDC of developer carrying member, charging voltage VD of electrostatic latent image bearing member, and laser power)

Evaluation image: 2 cm×5 cm image in center of the A4 paper

Test environment: Low-temperature low-humidity environment of 15° C., 10% RH (hereunder called "L/L")

Fixing temperature: 130° C.

Process speed: 377 mm/sec

The evaluation image was output and evaluated for low-temperature fixability. The image density decrease rate was used as the evaluation standard for low-temperature fixability.

For the image density decrease rate, the image density in the center of the image was first measured with an X-Rite color reflection densitometer (500 Series, X-Rite Inc.). The fixed image was then rubbed (5 passes) with Silbon paper under 4.9 kPa (50 g/cm$^2$) of load on the part that had been measured for image density, and the image density was measured again.

The decrease in image density after rubbing was then calculated by the following formula. The resulting image density decrease rate was evaluated according to the following standard. A rank of at least D means that the effects of the present invention have been obtained. The evaluation results are shown in Table 6.

Image density decrease rate=(image density before rubbing−image density after rubbing)/image density before rubbing×100

(Evaluation Standard)

AA: Image density decrease rate less than 3.0%

A: Image density decrease rate at least 3.0% and less than 5.0%

BB: Image density decrease rate at least 5.0% and less than 10.0%

B: Image density decrease rate at least 10.0% and less than 15.0%

CC: Image density decrease rate at least 15.0% and less than 20.0%

C: Image density decrease rate at least 20.0% and less than 25.0%

D: Image density decrease rate at least 25.0% and less than 30.0%

E: Image density decrease rate at least 30.0%

Method for Evaluating Hot Offset (H.O) Resistance

Using a modified Canon imagePRESS C800 full-color copier as the unfixed image-forming unit, the above two-component developer was placed in the cyan station developing device and evaluated.

GFC-081 plain copy paper (A4, basis weight 81.4 g/m$^2$, Canon Marketing Japan Inc.) was used as the evaluation paper. An unfixed toner image (toner laid-on level 0.08 mg/cm$^2$) 2.0 cm long and 15.0 cm wide were formed on a part 2.0 cm from the top of the paper in the direction of paper feed in a normal-temperature normal-humidity (23° C., 60% RH) environment.

A fixing test was performed using a fixing unit that had been removed from an imageRUNNER ADVANCE C5255 Canon full-color copier and modified so that the fixing temperature could be adjusted. In a normal-temperature normal-humidity environment (23° C., 5% RH), the process speed was set to 265 mm/s, and the temperature was raised from 160° C. to 210° C. in 5° C. increments as fixed images were obtained at each temperature from the previous unfixed images. The resulting fixed images were then evaluated for hot offset resistance.

Hot offset was evaluated visually in the fixed images and judged according to the following standard. A rank of at least D means that the effects of the present invention have been obtained. The evaluation results are shown in Table 6.

(Evaluation Standard)

AA: No hot offset even at 210° C.

A: Hot offset at 205° C.

BB: Hot offset at 200° C.

B: Hot offset at 195° C.

CC: Hot offset at 190° C.

C: Hot offset at least at 180° C. and less than 190° C.

D: Hot offset at least at 170° C. and less than 180° C.

E: Hot offset at below 170° C.

Method for Evaluating Fixing Separability

Using the above modified copier, a full-page solid image with a toner laid-on level of 0.60 mg/cm$^2$ was formed without fixing, leaving a 3.0 mm white margin at the upper edge of the page.

The unfixed image was then fixed at a process speed of 450 mm/second with the modified fixing unit.

To evaluate fixing separability, the fixing temperature was lowered from 200° C. in increments of 5° C. and 5° C. above the temperature at which wrapping occurred was given as the minimum fixing temperature. The test environment was a high-temperature high-humidity environment (30° C./80% RH).

A4 size CS-680 paper (Canon, 60 g/m$^2$) was used as the transfer material for the fixed image. The evaluation standard is shown below. A rank of at least D means that the effects of the invention have been obtained. The evaluation results are shown in Table 6.

(Evaluation Standard)

AA: Minimum fixing temperature less than 160° C.

A: Minimum fixing temperature 160° C.

BB: Minimum fixing temperature 165° C.
B: Minimum fixing temperature 170° C.
CC: Minimum fixing temperature 175° C.
C: Minimum fixing temperature 180° C.
D: Minimum fixing temperature 185° C.
E: Minimum fixing temperature at least 190° C.

Method for Evaluating Charge Retention in High-Temperature High-Humidity Environments The toner on the electrostatic latent image bearing member was collected by suction with a metal cylindrical tube and a cylindrical filter to measure the triboelectric charge quantity of the toner.

Specifically, the triboelectric charge quantity of the toner on the electrostatic latent image bearing member was measured with a Faraday cage. A Faraday cage is a coaxial double cylinder in which the inner and outer cylinder are insulated from each other. If a charged body with a charge quantity Q is placed in the inner cylinder, electrostatic induction makes it as though there is a metal cylinder with a charge quantity Q. This induced charge quantity is measured with an electrometer (Keithley 6517A, Keithley), and the charge quantity Q (mC) is divided by the toner mass M (kg) in the inner cylinder (Q/M), and regarded as the triboelectric charge quantity of the toner.

$$\text{Toner triboelectric charge quantity (mC/kg)} = Q/M$$

The image for evaluation was first formed on the electrostatic latent image bearing member, and before it could be transferred to the intermediate transfer member, the rotation of the electrostatic latent image bearing member was stopped, and the toner on the electrostatic latent image bearing member was collected by suction with a metal cylindrical tube and a cylindrical filter, and "initial Q/M" was measured.

Next, the evaluation unit was left standing for two weeks with the developing device still installed in a high-temperature, high-humidity environment (H/H), the same operations were performed as before, and the charge quantity Q/M (mC/kg) per unit mass on the electrostatic latent image bearing member after standing was measured. The initial Q/M per unit mass on the electrostatic latent image bearing member is taken as 100%, the retention rate of Q/M per unit mass on the electrostatic latent image bear member after standing ([Q/M after standing]/[initial Q/M]×100) was calculated and evaluated according to the following standard.

A rank of at least D means that the effects of the invention have been obtained. The evaluation results are shown in Table 6.

(Evaluation Standard)
A: Retention rate at least 95%
B: Retention rate at least 90% and less than 95%
C: Retention rate at least 85% and less than 90%
D: Retention rate at least 80% and less than 85%
E: Retention rate less than 80%

Method for Evaluating Fogging on Non-Image Part

Using a Canon imagePress C10000 VP full-color copier as the image forming apparatus, the two-component developer 1 was placed in the developing device of the cyan station and evaluated.

The evaluation environment was a high-temperature high-humidity environment (30° C. 80% RH), and GFC-081 plain copy paper (A4, basis weight 81.4 g/m$^2$, solid by Canon Marketing Japan Inc.) was used as the evaluation paper.

50000 sheets were output at an image print percentage of 20% and fogging of the white part before and ater endurance testing was measured.

The average reflectance Dr (%) of the evaluation paper before image output was measured with a reflectometer (Reflectometer Model TC-6DS, Tokyo Denshoku Co., Ltd.).

The reflectance Ds (%) of the 00H image part (white part) after endurance testing (50000th sheet) was also measured. The value of the Ds after endurance testing (50000th sheet) minus Dr was given as fogging (%) and evaluated according to the following standard. A rank of at least D means that the effects of the invention have been obtained. The evaluation results are shown in Table 6.

(Evaluation Standard)
A: Less than 0.5%
B: at least 0.5% and less than 1.0%
C: at least 1.0% and less than 2.0%
D: at least 2.0% and less than 3.0%
E: At least 3.0%

Examples 1 to 50

The above evaluations were performed using the toners 1 to 50 (two-component developers 1 to 50).

Comparative Examples 1 to 10

The above evaluations were performed using the toners 51 to 60 (two-component developers 51 to 60).

[Table 6]

| | Low-temperature fixability LL | | H.O resistance NL | | Fixing separability HH | | Fogging of non-image part HH | | HH charge retention HH | |
|---|---|---|---|---|---|---|---|---|---|---|
| Toner No. | DDR (%) | Rank | HOT (° C.) | Rank | MFT (° C.) | Rank | Ds − Dr (%) | Rank | RR (%) | Rank |
| 1 | 0.9 | AA | 210 | AA | 155 | AA | 0.1 | A | 99 | A |
| 2 | 1.0 | AA | 205 | A | 155 | AA | 0.1 | A | 97 | A |
| 3 | 1.2 | A | 205 | A | 155 | AA | 0.1 | A | 96 | A |
| 4 | 1.3 | AA | 205 | A | 160 | A | 0.2 | A | 98 | A |
| 5 | 1.5 | AA | 205 | A | 160 | A | 0.2 | A | 99 | A |
| 6 | 1.5 | AA | 205 | A | 160 | A | 0.3 | A | 98 | A |
| 7 | 1.5 | AA | 205 | A | 160 | A | 0.2 | A | 96 | A |
| 8 | 3.8 | A | 205 | A | 160 | A | 0.1 | A | 93 | B |
| 9 | 3.6 | A | 200 | BB | 160 | A | 0.3 | A | 96 | A |
| 10 | 2.5 | AA | 205 | A | 160 | A | 0.2 | A | 94 | B |
| 11 | 3.7 | A | 200 | BB | 165 | BB | 0.6 | B | 95 | A |
| 12 | 3.7 | A | 200 | BB | 165 | BB | 0.5 | B | 93 | B |
| 13 | 5.2 | BB | 205 | A | 160 | A | 1.4 | C | 92 | B |
| 14 | 5.1 | BB | 205 | A | 165 | BB | 0.3 | A | 94 | B |
| 15 | 3.5 | A | 200 | BB | 165 | BB | 0.3 | A | 96 | A |

-continued

| | Low-temperature fixability LL | | H.O resistance NL | | Fixing separability HH | | Fogging of non-image part HH | | HH charge retention HH | |
|---|---|---|---|---|---|---|---|---|---|---|
| Toner No. | DDR (%) | Rank | HOT (° C.) | Rank | MFT (° C.) | Rank | Ds − Dr (%) | Rank | RR (%) | Rank |
| 16 | 5.5 | BB | 205 | A | 165 | BB | 0.6 | B | 91 | B |
| 17 | 10.5 | B | 200 | BB | 165 | BB | 0.6 | B | 93 | B |
| 18 | 4.0 | A | 195 | B | 170 | B | 0.7 | B | 92 | B |
| 19 | 6.5 | BB | 195 | B | 170 | B | 0.7 | B | 86 | C |
| 20 | 3.5 | A | 200 | BB | 170 | B | 0.8 | B | 96 | A |
| 21 | 7.4 | BB | 200 | BB | 170 | B | 1.5 | C | 96 | A |
| 22 | 4.4 | A | 195 | B | 170 | B | 0.3 | A | 96 | A |
| 23 | 4.5 | A | 195 | B | 170 | B | 0.9 | B | 93 | B |
| 24 | 6.5 | BB | 195 | B | 170 | B | 1.3 | C | 86 | C |
| 25 | 11.5 | B | 195 | B | 175 | CC | 0.3 | A | 96 | A |
| 26 | 11.0 | B | 195 | B | 175 | CC | 0.3 | A | 93 | B |
| 27 | 10.9 | B | 195 | B | 175 | CC | 0.6 | B | 92 | B |
| 28 | 12.3 | B | 190 | CC | 175 | CC | 1.8 | C | 90 | B |
| 29 | 17.0 | CC | 195 | B | 175 | CC | 0.3 | A | 96 | A |
| 30 | 20.9 | C | 195 | B | 175 | CC | 0.3 | A | 96 | A |
| 31 | 14.5 | B | 190 | CC | 175 | CC | 0.3 | A | 96 | A |
| 32 | 14.7 | B | 195 | B | 175 | CC | 2.2 | D | 82 | D |
| 33 | 18.5 | CC | 195 | B | 175 | CC | 2.5 | D | 82 | D |
| 34 | 12.5 | B | 190 | CC | 180 | C | 0.3 | A | 96 | A |
| 35 | 12.8 | B | 195 | B | 175 | CC | 0.3 | A | 91 | B |
| 36 | 11.3 | B | 195 | B | 175 | CC | 0.3 | A | 91 | B |
| 37 | 14.7 | B | 195 | B | 175 | CC | 0.3 | A | 91 | B |
| 38 | 14.3 | B | 195 | B | 175 | CC | 0.3 | A | 91 | B |
| 39 | 13.3 | B | 195 | B | 175 | CC | 0.3 | A | 91 | B |
| 40 | 14.8 | B | 190 | CC | 175 | CC | 0.3 | A | 90 | B |
| 41 | 14.9 | B | 195 | B | 175 | CC | 0.3 | A | 93 | B |
| 42 | 13.3 | B | 195 | B | 170 | B | 0.3 | A | 93 | B |
| 43 | 13.7 | B | 190 | CC | 180 | C | 0.3 | A | 90 | B |
| 44 | 13.1 | B | 190 | CC | 180 | C | 0.3 | A | 90 | B |
| 45 | 16.6 | CC | 190 | CC | 180 | C | 1.4 | C | 86 | C |
| 46 | 16.9 | CC | 190 | CC | 180 | C | 1.8 | C | 86 | C |
| 47 | 23.1 | C | 180 | C | 180 | C | 1.6 | C | 88 | C |
| 48 | 28.3 | D | 180 | C | 180 | C | 2.7 | D | 86 | C |
| 49 | 28.0 | D | 180 | C | 185 | D | 2.4 | D | 85 | C |
| 50 | 29.9 | D | 170 | D | 185 | D | 2.6 | D | 82 | D |
| 51 | 33.5 | E | 205 | A | 160 | A | 3.1 | E | 78 | E |
| 52 | 35.6 | E | 195 | B | 170 | B | 3.5 | E | 74 | E |
| 53 | 30.8 | E | 180 | C | 180 | C | 3.4 | E | 76 | E |
| 54 | 32.2 | E | 170 | D | 200 | E | 0.8 | B | 93 | B |
| 55 | 33.4 | E | 170 | D | 200 | E | 0.9 | B | 93 | B |
| 56 | 35.2 | E | 170 | D | 200 | E | 3.1 | E | 83 | D |
| 57 | 33.1 | E | 170 | D | 200 | E | 2.9 | D | 82 | D |
| 58 | 31.0 | E | 165 | E | 200 | E | 0.6 | B | 93 | B |
| 59 | 37.2 | E | 165 | E | 200 | E | 0.6 | B | 93 | B |
| 60 | 38.0 | E | 160 | E | 200 | E | 3.8 | E | 72 | E |

The abbreviations in the Table 8 are defined as follows.
DDR: Density decrease rate
HOT: H.O occurrence temperature
MFT: Minimum fixing temperature
RR: Retention rate While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-225355, filed Dec. 13, 2019, which is hereby incorporated by reference herein in its entirety.

What is claimed is:

1. A toner, comprising:

a toner particle containing a binder resin and a multivalent metal element;

the binder resin comprising a first crystalline resin having an acid value of 0.1 to 30 mg KOH/g and a second amorphous resin having an acid value of 0.5 to 40 mg KOH/g;

the first resin having a first monomer unit at a content ratio of 30.0 to 99.9 mass %

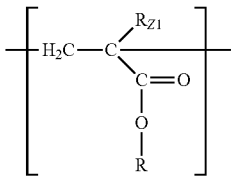

(1)

where $R_{Z1}$ represents a hydrogen atom or methyl group, and R represents a $C_{18-36}$ alkyl group; and a domain-matrix structure formed of a matrix containing the first resin and domains containing the second resin appears in cross-sectional observation of the toner, wherein the multivalent metal element is at least one member selected from the group consisting of Mg, Ca, Al, Fe and Zn, and a total content of the multivalent metal element is 0.0025 to 3.0000 mass parts per 100 mass parts of the binder resin.

2. The toner according to claim 1, wherein X/Y is 0.2 to 2.5 where X is a content of the first resin in the binder resin and Y is a content of the second resin in the binder resin.

3. The toner according to claim 1, wherein a number-average diameter of the domains in cross-sectional observation of the toner is 0.1 to 2.0 μm.

4. The toner according to claim 1, wherein the total content of the multivalent metal element in the toner is 0.0025 to 0.0500 mass parts per 100 mass parts of the binder resin.

5. The toner according to claim 1, wherein the second resin is a polyester resin having a polycondensation structure of dodecenylsuccinic acid or an anhydride thereof.

6. The toner according to claim 5, wherein the polyester resin has a polycondensation structure of a carboxylic acid component other than the polycondensation structure of dodecenylsuccinic acid and anhydride thereof.

7. The toner according to claim 1, wherein Mw(A) is 25000 to 60000 and Mw(A)/Mn(A) is 5 to 10 when Mw(A) is a weight-average molecular weight in gel permeation chromatography measurement of a tetrahydrofuran-soluble component of the toner and Mn(A) is a number-average molecular weight in gel permeation chromatography measurement of a tetrahydrofuran-soluble component of the toner.

8. The toner according to claim 1, wherein a content of the first resin in the binder resin is at least 30.0 mass %.

9. The toner according to claim 1, wherein the toner particle contains at least one monovalent metal element selected from the group consisting of Na, Li and K.

10. The toner according to claim 9, wherein a content of the monovalent metal element is 45 to 90 mass %, based on a total content of the multivalent and monovalent metal elements.

11. The toner according to claim 1, wherein a complex elastic modulus of the toner at 65° C. is $1.00\times10^7$ to $5.00\times10^7$ Pa, and the complex elastic modulus of the toner at 85° C. is not more than $1.00\times10^6$ Pa.

12. The toner according to claim 1, wherein the binder resin also contains a third resin, and the third resin links the first resin to the second resin.

13. The toner according to claim 1, wherein the second resin is at least one member selected from the group consisting of vinyl resins, polyester resins and hybrid resins of vinyl resins linked to polyester resins.

14. The toner according to claim 1, wherein the first resin has a second monomer unit that is different from the first monomer unit comprising at least one member selected from the group consisting of formula (2) and formula (3)

(2)

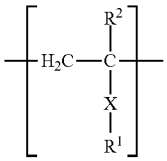

-continued (3)

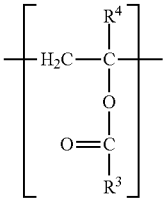

where X is a single bond or $C_{1-6}$ alkylene group, $R^1$ is —C≡N, —C(=O)NHR$^{10}$ (where R$^{10}$ represents a hydrogen atom or $C_{1-4}$ alkyl group), a hydroxy group, —COOR$^{11}$ (where R$^{11}$ represents a $C_{1-6}$ alkyl group or $C_{1-6}$ hydroxyalkyl group), —NH—C(=O)—N(R$^{13}$)$_2$ (where each of two R$^{13}$s independently represents a hydrogen atom or $C_{1-6}$ alkyl group), —COO(CH$_2$)$_2$NHCOOR$^{14}$ (where R$^{14}$ represents a $C_{1-4}$ alkyl group) or —COO(CH$_2$)$_2$—NH—C(=O)—N(R$^{15}$)$_2$ (where each of the two R$^{15}$s independently represents a hydrogen atom or $C_{1-6}$ alkyl group), $R^2$ represents a hydrogen atom or methyl group, $R^3$ represents a $C_{1-4}$ alkyl group, and $R^4$ represents a hydrogen atom or methyl group, and $SP_{21}$ is at least 21.00 $(J/cm^3)^{0.5}$ when $SP_{21}$ is an SP value of the second monomer unit.

15. The toner according to claim 1, wherein the toner is non-magnetic.

16. The toner according to claim 1, wherein the multivalent metal element is contained in the toner particle in a non-phase dispersed state.

17. A method for manufacturing a toner, the method comprising the steps of:

preparing a resin fine particle dispersion containing a binder resin;

adding a flocculant to the resin fine particle dispersion to form aggregate particles; and heating and fusing the aggregate particles to obtain a dispersion containing a toner particle, wherein the binder resin comprising a first crystalline resin having an acid value of 0.1 to 30 mg KOH/g and a second amorphous resin having an acid value of 0.5 to 40 mg KOH/g;

the first resin having a first monomer unit at a content ratio of 30.0 to 99.9 mass %

(1)

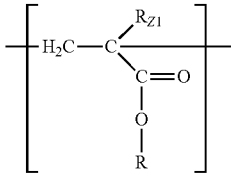

where $R_{Z1}$ represents a hydrogen atom or methyl group, and R represents a $C_{18-36}$ alkyl group; and a domain-matrix structure formed of a matrix containing the first resin and domains containing the second resin appears in cross-sectional observation of the toner, wherein the multivalent metal element is at least one member selected from the group consisting of Mg, Ca, Al, Fe and Zn, and a total content of the multivalent metal element is 0.0025 to 3.0000 mass parts per 100 mass parts of the binder resin.

18. The method for manufacturing a toner according to claim 17, wherein the flocculant is a metal salt containing at least one metal element selected from the group consisting of Mg, Ca, Al, Fe and Zn.

19. The method for manufacturing a toner according to claim 17, further comprising the steps of:

adding a chelating compound having chelating ability with respect to metal ions to a dispersion containing the toner particle; and removing at least part of the multivalent metal element, thereby adjusting a content of the multivalent metal element.

* * * * *